US006143483A

United States Patent [19]

Ikeda et al.

[11] Patent Number: 6,143,483

[45] **Date of Patent: *Nov. 7, 2000**

[54] SILVER HALIDE EMULSION AND SILVER HALIDE COLOR PHOTOGRAPHIC LIGHT-SENSITIVE MATERIAL

[75] Inventors: Hideo Ikeda; Mitsuo Saitou, both of MInami-ashigara, Japan

[73] Assignee: Fuji Photo Film Co., Kanagawa-Ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/925,710

[22] Filed: Sep. 9, 1997

[30] Foreign Application Priority Data

Sep. 9, 1996 [JP] Japan ..... 8-257361

[51] Int. Cl.[7] ..... G03K 1/035; G03C 1/04; G03C 1/06

[52] U.S. Cl. ..... 430/509; 430/567; 430/569; 430/637

[58] Field of Search ..... 430/567, 569, 430/637, 509

[56] References Cited

U.S. PATENT DOCUMENTS

| | | | |
|---|---|---|---|
| 4,386,156 | 5/1983 | Mignot | 430/567 |
| 5,275,930 | 1/1994 | Maskasky | 430/567 |
| 5,292,632 | 3/1994 | Maskasky | 430/567 |
| 5,494,789 | 2/1996 | Daubendiek et al. | 430/567 |
| 5,576,171 | 11/1996 | Olm et al. | 430/567 |
| 5,783,373 | 7/1998 | Mydlarz et al. | 430/363 |
| 5,783,378 | 7/1998 | Mydlarz et al. | 430/567 |
| 5,807,665 | 9/1998 | Saitou | 430/569 |

FOREIGN PATENT DOCUMENTS

| | | | |
|---|---|---|---|
| 0534395A1 | 3/1993 | European Pat. Off. | G03C 1/005 |

*Primary Examiner*—Mark F. Huff
*Attorney, Agent, or Firm*—Birch, Stewart, Kolasch & Birch LLP

[57] ABSTRACT

There is disclosed a silver halide emulsion that comprises at least a dispersion medium and silver halide grains, wherein 60% or more of the total projected area of the silver halide grains is occupied by tabular grains having an epitaxial junction, which grains each have a {100} face as a main plane and an aspect ratio (diameter/thickness ratio) of from 2.0 to 100; and wherein a right-angled parallelogram enclosed with {100} side faces at the main plane edges on the portion of the tabular grains, which portion does not have the epitaxial junction, or if the tabular grains have at least one corner broken off, a right-angled parallelogram formed by extending the {100} side faces at the main plane edges, has a slenderness side ratio (a ratio of the length of the long side to that of the short side) of 1 to 6; and wherein the tabular grains have the epitaxial junction with a silver halide protrusion that has a higher solubility than the portion of the tabular grains, which portion does not have the epitaxial junction. There is also disclosed a silver halide emulsion the same to the above, except that (A) the tabular grains have no epitaxy but crystal defects for anisotropic growth and an aspect ratio of 2.0 or more, and (B) a six-coordinate dopant capable of forming a shallow electron trap is present in a crystal lattice. The silver halide emulsions are high in sensitivity and image quality, and they are excellent in suppression of dependency on a processing solution pH and in preservability of latent image, and they can be utilized in silver halide color photographic light-sensitive materials.

18 Claims, 1 Drawing Sheet

SILVER HALIDE EMULSION AND SILVER HALIDE COLOR PHOTOGRAPHIC LIGHT-SENSITIVE MATERIAL

FIELD OF THE INVENTION

The present invention relates to a silver halide (hereinafter a silver halide is also referred to as "AgX") emulsion useful in the field of photography. More specifically, the present invention relates to a silver halide emulsion that is excellent in sensitivity, and that is excellent in each of suppression of dependence on a processing solution pH, and preservability of a latent image.

Further, the present invention relates to a silver halide color photographic light-sensitive material that is excellent in sensitivity and image quality.

BACKGROUND OF THE INVENTION

As compared with non-tabular AgX grains, use of tabular AgX emulsion grains in photographic light-sensitive materials reduces the ratio of incident light's passing through the light-sensitive layer without being utilized, to thereby increase efficiency of light absorption (trapped light), and such use also brings about improvements in image quality in terms of covering power, sharpness and graininess (granularity), development progress, spectral sensitization characteristics, and the like. Tabular grains having twinning planes parallel to each other and {111} faces as main planes have therefore been used frequently. While a {111} face is a face generally made up mostly of halide ions (hereinafter also referred to as $X^-$), a {100} face is a face made up of $Ag^+$ and $X^-$ alternating with each other, and it provides superior photographic properties. Therefore, interest has recently turned to tabular grains whose main planes are {100} faces. For the details of conventional {100} tabular grains, reference can be made to JP-A-51-88017 ("JP-A" means unexamined published Japanese patent application), JP-B-64-8323 ("JP-B" means examined Japanese patent publication), JP-A-5-281640, 5-313273, 6-59360, and 6-324446, EP-A-0 534 395 (Al), and U.S. Pat. Nos. 5,292,632, 5,314,798, and 5,264,337. The present invention is to provide an improved {100} tabular grain emulsion as compared with the conventional {100} tabular grain emulsion. While {100} tabular grains owe their tabular form to crystal defects that enable preferential growth in the edge direction, the shape characteristics and photographic characteristics of tabular grains largely vary depending on the method of crystal defect formation. These characteristics also largely vary depending on the method of grain growth. Hence, improvements in methods of defect formation and grain growth have been attracting attention.

EP-A-0 534 395 (Al) describes a method of forming tabular grains in the presence of an adsorbent that accelerates the formation of a {100} face. However, the technique disclosed yields unsatisfactory results in terms of grain shape and photographic properties.

Further, conventional {100} tabular grains are also practically unsatisfactory in terms of suppression of dependence on a processing solution pH and preservability of a latent image.

SUMMARY OF THE INVENTION

An object of the present invention is to provide an AgX emulsion that is more excellent in terms of sensitivity/image quality, and that is excellent in suppression of dependence on a processing solution pH, preservability of a latent image, and the like.

Another object of the present invention is to provide a silver halide color photographic light-sensitive material that is excellent in terms of sensitivity/image quality.

Other and further objects, features, and advantages of the invention will appear more fully from the following description, taken in connection with the accompanying drawings.

DETAILED DESCRIPTION OF THE INVENTION

Figure 1:
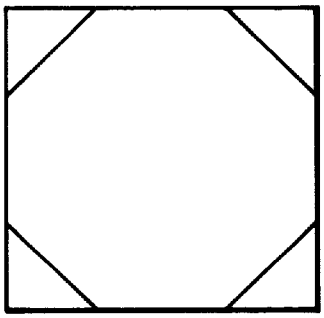
FIG. 1 is a plan view of a tetradecahedral AgBr grain.

The above-described objects of the present invention have been attained by the following:

(1) A silver halide emulsion that comprises at least a dispersion medium and silver halide grains, wherein 60% or more of the total projected area of the said silver halide grains is occupied by tabular grains having an epitaxial junction, which grains each have a {100} face as a main plane and an aspect ratio (diameter/thickness ratio) of from 2.0 to 100; and wherein a right-angled parallelogram enclosed with {100} side faces at the main plane edges on the portion of the tabular grains, which portion does not have the epitaxial junction, or if the tabular grains have at least one corner broken off (missing), a right-angled parallelogram formed by extending the {100} side faces at the main plane edges, has a slenderness side ratio (a ratio of the length of the long side to that of the short side) of 1 to 6; and wherein the tabular grains have the epitaxial junction with a silver halide protrusion that has a higher solubility than the portion of the tabular grains, which portion does not have the epitaxial junction.

(2) A silver halide emulsion that comprises at least a dispersion medium and silver halide grains, wherein 60% or more of the total projected area of the said silver halide grains is occupied by tabular grains having crystal defects for anisotropic growth, which grains each have a {100} face as a main plane and an aspect ratio (diameter/thickness ratio) of not less than 2.0; and wherein a right-angled parallelogram enclosed with {100} side faces at the main plane edges of the tabular grains, or if the tabular grains have at least one corner broken off, a right-angled parallelogram formed by extending the {100} side faces at the main plane edges, has a slenderness side ratio (a ratio of the length of the long side to that of the short side) of 1 to 6; and wherein a six-coordinate dopant capable of forming a shallow electron trap is present in a crystal lattice.

(3) The silver halide emulsion as described in the above (1), wherein the side tabular grains have crystal defects for anisotropic growth, and wherein a six-coordinate dopant capable of forming a shallow electron trap in the said tabular grains and/or the said silver halide protrusion, is present in a crystal lattice.

(4) The silver halide emulsion as described in one of the above (1), (2), or (3), wherein the silver halide emulsion is prepared in the presence of a compound $A^0$ and/or a compound $B^0$, wherein the compound $A^0$ represents an organic compound having covalently bonded to each individual molecule thereof at least two molecules of an adsorbent that accelerates formation of a {100} face of AgBr grains, wherein the compound $B^0$ represents an organic compound, except gelatins, having at least two alcoholic groups (hydroxyl groups) per molecule, and wherein both the compounds $A^0$ and $B^0$ are organic compounds, except gelatins and other proteins.

(5) The silver halide emulsion as described in the above (3), wherein the said crystal defects are formed by addition of $Ag^+$ and halide ions with the compound $A^0$ and/or the compound $B^0$ being adsorbed on the silver halide grains.

(6) The silver halide emulsion as described in the above (3), wherein the said crystal defects are formed by forming at least one halogen composition gap interface during nucleation, the halogen composition gap interface making a halogen composition difference of 10 mol % or more in a $Cl^-$, $Br^-$, or $I^-$ content.

(7) A silver halide color photographic light-sensitive material comprising a blue-sensitive emulsion layer, a green-sensitive emulsion layer, and a red-sensitive emulsion layer, on a support, wherein at least one of these color-sensitive emulsion layers comprises a color-sensitive layer unit that is composed of at least two light-sensitive layers each having different sensitivity; and wherein a layer having the lowest sensitivity of the color-sensitive layer unit, contains at least one silver halide emulsion selected from those described in the above (1), (2), (3), (4), (5), or (6), and a layer having the highest sensitivity of the color-sensitive layer unit, contains an emulsion comprising light-sensitive silver halide tabular grains each having a {111} face as a main plane and an aspect ratio of not less than 2.

Additional preferable embodiments of the present invention are described below.

(8) The silver halide emulsion as described in the above (3), wherein the crystal defects are formed by first forming $AgX_0$ nuclei that are substantially free from the crystal defect; then adding the compound $A^0$ and/or the compound $B^0$, to be adsorbed on the nuclei, and thereafter adding $Ag^+$ and a halogen ion, to be built up layers on the $AgX_0$ nuclei.

(9) The silver halide emulsion as described in one of the above (1) to (6), and (8), wherein the compound $A^0$ is a polymer comprising at least one ethylenically unsaturated monomer and containing at least two of an imidazole group and/or a benzoimidazole group per molecule thereof.

(10) The silver halide emulsion as described in one of the above (1) to (6), and (8), wherein the compound $B^0$ is a polyvinyl alcohol having a molecular weight of 300 or more, and having an $X_1$ value (the ratio of the number of alcoholic groups to the total number of functional groups) per molecule of from 0.2 to 1.0.

(11) The silver halide emulsion as described in one of the above (1) to (6) and (8) to (10), wherein the concentration of the compound $A^0$ and/or the compound $B^0$ to be present is a concentration enough to provide an equilibrium crystal habit potential-shifted amount of 10 mV or more.

(12) The silver halide color photographic light-sensitive material as described in the above (7), wherein the layer having the lowest sensitivity contains the silver halide emulsion as described in one of the above (8) to (11).

The present invention is explained in more details below.

The above-described compound $A^0$ is preferably represented by general formula (1), and the compound $B^0$ is preferably represented by general formula (2), shown below, in which a, b, d, and e each represent a weight percentage of each component, a+b=100, d+e=100.

$$-(A)_a-(B)_b- \qquad \text{General formula (1)}$$

$$-(D)_d-(E)_e- \qquad \text{General formula (2)}$$

These compounds are explained below in turn.

(I) Compound $A^0$

Compound $A^0$ is an organic compound having covalently bonded thereto at least 2, preferably 4 to $10^3$, more preferably 8 to 100, and further preferably 20 to 100 molecules of an adsorbent $C^0$ that accelerates formation of {100} faces of AgBr grains per molecule thereof. The compound $A^0$ is a compound having the following characteristics.

First, normal crystal AgBr emulsion grains having an average diameter of about 0.2 μm are formed in the presence of a conventional photographic gelatin. From the resulting emulsion are sampled $N^0$ emulsions of equal amount, as seed crystals. One of these emulsions is put into an aqueous solution of a conventional photographic gelatin dispersion medium, and $Ag^+$ and $Br^-$ are added thereto at 60° C. while keeping the silver potential constant according to a double jet process, thereby to allow the seed crystals to grow to an average diameter of about 1.0 μm, without inducing formation of new nuclei. The experiments are carried out in the same manner, except for at various different silver potentials, to obtain the relationship of silver potential vs. grain shape. On the other hand, another series of experiments is carried out in the same manner, except that compound $A^0$, having adsorbent $C^0$ covalently bonded as described above (having a residual group of the adsorbent bonded), is added, in an amount of 30% by weight based on the gelatin in the aqueous solution, to similarly obtain the relationship of silver potential vs. grain shape. The amount of gelatin present in the aqueous solution at the start of grain growth is 18 g/l, and the amount of $Ag^+$ added is 70 g in terms of silver nitrate ($AgNO_3$). The pH is a given value that is not lower than the pKa of compound $A^0$, preferably (pKa+0.5). Herein, "pKa" represents a value of an acid dissociation constant. The silver potential as referred to above is a potential of a silver rod with reference to a saturated calomel electrode at room temperature. The silver potential can be measured by using an AgBr electrode, an AgI electrode, an $Ag_2S$ electrode, or a mixed crystal electrode of these two or more electrodes in place of the silver rod. All comparative experiments of the above two series should be carried out under the same conditions, except for the presence or absence of compound $A^0$.

Comparison of the results of the two series of experiments reveals that the silver potential required to obtain tetradecahedral grains in the latter grain formation is lower (shifted to lower potential side) than that required to obtain grains of the same shape in the former gelatin system, by generally 10 mV or more, preferably 20 to 150 mV, more preferably 30 to 120 mV, and particularly preferably 50 to 100 mV. When such a low potential shift is caused by making a certain compound present in a certain amount, the amount of potential shifted is called "an equilibrium crystal habit potential-shifted amount" in the present specification. The tetradecahedral grains are preferably tetradecahedral grains in which the corners of each cubic grain are broken off (missed) by, in average, 30% of each side length. The plan view of such a tetradecahedral grain is shown in FIG. 1. For the particulars of silver potential measurement, reference can be made to Shin Munemori et al. (trans.), *Ion Sentakusei Denkyoku,* Kyoritsu Shuppoan (1977), and *Denki kagaku Binran,* Ch. 5, Maruzen (1985).

Herein, the adsorbent $C^0$ is an organic compound containing at least one nitrogen atom N having a resonance stabilized π-electron pair. Examples of the adsorbent $C^0$ include 1) heterocyclic compounds containing nitrogen in their ring, such as substituted or unsubstituted and saturated or unsaturated heterocyclic compounds containing one nitrogen atom as a sole hetero atom in their ring (e.g. pyridine, indole, pyrrolidine, and quinoline), and substituted or unsubstituted and saturated or unsaturated heterocyclic compounds containing one nitrogen atom and at least one additional hetero atom selected from nitrogen and oxygen in their ring (e.g. imidozoline, imidazole, pyrazole, oxazole, piperazine, triazole, tetrazole, oxadiazole, oxatriazole, dioxazole, pyrimidine, pyrimidazole, pyrazine, triazine, tetrazine, and benzimidazole).

In addition, examples of the adsorbent $C^0$ also include 2) organic compounds having a nitrogen-containing group that has an aromatic ring substituted on the nitrogen atom, represented by the following formula (3). In formula (3), Ar represents an aromatic ring having 5 to 14 carbon atoms, preferably an aromatic ring comprising a carbon ring; and $R^1$ and $R^2$ each represent a hydrogen atom, Ar, or an aliphatic group, or they are taken together to form a 5- or 6-membered ring (e.g. aniline, α-naphthylamine, carbazole, 1,8-naphthyridine, nicotine, and benzoxazole). For the other particulars, reference can be made to EP-A-0 534 395 (A1) and JP-A-6-19029. Imidazole and benzoimidazole are preferred of these compounds.

The compound $A^0$ can be prepared by polymerizing (including dimerizing) a polymerizable ethylenically unsaturated monomer represented by general formula (4) shown below, or by copolymerizing the monomer with a polymerizable ethylenically unsaturated monomer represented by general formula (5) shown below. The monomers of general formula (4) may be used either individually or as a mixture of two or more thereof. The copolymerization ratio of monomers is selected so as to meet the aforesaid embodiment. In general formula (4), $C^1$ represents a residual group of the adsorbent $C^0$ bonded to the monomer. In general formula (5), $d^1$ represents a functional group (e.g. amido, morpholino, pyrrolidone, sulfonic acid, sulfinic acid, and carboxylic acid groups of the specific compounds hereinafter referred to). The compound of formula (4) provides the portion of A, and when copolymerized, the compound of formula (5) provides the portion of B or E in the formulae (1) and (2).

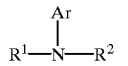

(3)

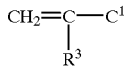

(4)

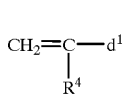

(5)

wherein $R^3$ and $R^4$ each represent a hydrogen atom, or an alkyl group having 1 to 10, preferably 1 to 5, carbon atoms.

Specific examples of the compound of general formula (4) include compounds, such as monomers having a heterocyclic group containing a basic nitrogen atom, e.g. vinylimidazole, 2-methyl-1-vinylimidazole, 4-vinylpyridine, 2-vinylpyridine, N-vinylcarbazole, 4-acrylamidopyridine, N-acryloylimidazole, N-2-acryloyloxyethylimidazole, 4-N-(2-acryloyloxyethyl)-aminopyridine, 1-vinylbenzoimidazole, N-vinylbenzylimidazole, N-methacryloyloxyethylpyrrolidine, N-acryloylpiperazine, 1-vinyltriazole, 3,5-dimethyl-1-vinylpyrazole, N-methacryloyloxyethylmorpholine, N-vinylbenzylpiperidine, and N-vinylbenzylmorpholine.

The copolymerizable ethylenically unsaturated monomers that can provide the repeating unit of B in general formula (1) preferably include those providing a homopolymer soluble in any of acidic, neutral, or alkaline aqueous solutions. Specific examples of the compounds include nonionic monomers, such as acrylamide, methacrylamide, N-methylacrylamide, N,N-dimethylacrylamide, N-acryloylmorpholine, N-ethylacrylamide, diacetonacrylamide, N-vinylpyrrolidone, and N-vinylacetamide; monomers having an anionic group, such as acrylic acid, methacrylic acid, itaconic acid, vinylbenzoic acid, styrenesulfonic acid, styrenesulfinic acid, phosphonoxyethyl acrylate, phosphonoxyethyl methacrylate, 2-acrylamido-2-methylpropanesulfonic acid, and 3-acrylamidopropionic acid; salts of these monomers; and monomers having a cationic group, such as N,N,N-trimethyl-N-vinylbenzylammonium chloride and N,N,N-trimethyl-N-3-acrylamidopropylammonium chloride.

B is a copolymer of one or more of these monomers. Further, in B, may be coporimerized with some other hydrophobic ethylenically unsaturated monomers, in an amount within the range that would not impair water solubility of the molecule of general formula (1) as a whole.

Examples of the ethylenically unsaturated monomers include ethylene, propylene, 1-butene, styrene, α-methylstyrene, methylvinyl ketone, fatty acid mono-ethylenically unsaturated esters, such as vinyl acetate and allyl acetate; ethylenically unsaturated monocarboxylic or dicarboxylic acid esters, such as methacrylates; ethylenically unsaturated monocarboxylic acid amides, such as t-butylacrylamide; mono-ethylenically unsaturated compounds, such as acrylonitrile and methacrylonitrile; and diene compounds, such as butadiene and isoprene.

In formula (1), a is generally (0.002 to 1.0)×100, preferably (0.01 to 0.8)×100, more preferably (0.05 to 0.7)×100, and further preferably (0.15 to 0.6)×100. The molecular weight of the compound $A^0$ is generally 150 to $10^6$, preferably 300 to $3\times10^5$, and more preferably $10^3$ to $3\times10^5$.

In formula (4), $C^1$ and an ethylenically unsaturated monomer can be chemically bonded via a divalent linking group L, such as in $H_2C{=}C(H)—L—C^1$, in addition to their being directly bonded as shown in formula (5), described later. Examples of the chemical bonding via a divalent linking group L include such modes of $H_2C{=}C(H)—CONH—C^1$ and $H_2C{=}C(H)COO—C^1$. The divalent linking group L and a bonding system are described in detail in JP-A-3-109539 and 4-226449.

More generally, the compound $A^0$ is a polymer in which generally two molecules or more (preferably 4 to $10^3$ molecules, more preferably 8 to 100 molecules, and further preferably 20 to 100 molecules) of polymerizable monomers having the $C^1$ group are polymerized. The compound $A^0$ can be formed by polymerizing the poymerizable monomer having the $C^1$ group, or by bonding the $C^1$ group to a previously-present polymer. Example polymerization methods for obtaining the compound $A^0$ include addition polymerization, condensation polymerization, polyaddition polymerization, ring-opening polymerization, and addition condensation. Among these, addition polymerization of a vinyl compound, a vinylidene compound, and a diene compound is preferable, and addition polymerization of a vinyl compound is more preferable. These polymerization methods are described in detail in *Shinjikken Kagaku Koza,* vol.

19, "High Molecule chemistry [I]", Maruzen, (1978); and *Jikken Kagaku Koza* (4th edition), vol. 28–29, Maruzen (1992). The polymerizable monomer has one or more groups of $C^1$, preferably 1 to 3 groups of $C^1$, and more preferably 1 group of $C^1$. The $C^1$ group can be bonded as a branched chain of the polymer rather than a main chain of the polymer. The compound $A^0$ is preferably a polymer of at least one ethylenically unsaturated monomer, and it has generally at least 2, preferably 4 to $10^3$, more preferably 8 to 100, and further preferably 20 to 100 imidazole groups or benzoimidazole groups per molecule.

(II) Compound $B^0$

Compound $B^0$ is an organic compound other than proteins and gelatins, and it preferably has a molecular weight of 90 or more, more preferably 300 to $10^6$, further preferably $10^3$ to $10^5$, and most preferably 3000 to $10^5$; and it contains at least 2, preferably 4 to $10^5$, more preferably 10 to $10^4$, further preferably 30 to $10^3$, and most preferably 100 to $10^3$ alcoholic groups per molecule. The ratio of the number of alcoholic groups to the total number of functional groups per molecule ($=X_1$) is preferably 0.05 or more, more preferably 0.2 to 1.0, further preferably 0.4 to 1.0, and most preferably 0.6 to 1.0. The term "functional group" as used herein means residual groups that are more reactive than hydrocarbon residual groups, such as a methyl group, the functional groups including hetero atom groups, and hetero atom-containing atomic groups. The ratio of the total mass of the alcoholic groups to the total mass of a molecule per molecule ($=X_2$) is preferably 0.01 to 0.6, more preferably 0.05 to 0.55, and most preferably 0.1 to 0.5.

Specific examples of the compound $B^0$ include 1) carbohydrates, 2) polyhydric alcohols, and 3) polymers represented by formula (2), as described below in detail.

1) Carbohydrates

The carbohydrates are polysaccarides satisfying the above-specified molecular weight condition, and examples of them include homopolysaccharides comprising a single kind of a constituent sugar, and heteropolysaccharides comprising two or more kinds of constituent sugars. Examples of the constituent sugars include monosaccharides having a molecular formula of $(CH_2O)_n$, wherein n is 5 to 7; sugar alcohols, aldonic acids having a —COOH group in place of a —CHO group, uronic acids having a —COOH group in place of a —$CH_2OH$ group, and amino sugars. In addition, sugar derivatives (e.g. viscose, methyl cellulose, ethyl cellulose, hydroxyethyl cellulose, carboxymethyl cellulose, soluble starch, carboxymethyl starch, dialdehyde starch, and glycosides) are also included. Carbohydrates other than nucleic acid are preferable. Carbohydrates other than glycosides are more preferable.

Specific examples of the carbohydrates include starchs (e.g. sugar cane starch, potato starch, tapioca starch, wheat starch, and corn starch), konjak (konjak mannan), funori (a glue plant), agar (agar-agar), sodium alginate, hibiscus (root), tragacanth, gum (rubber), gum arabic, dextran, dextrin, and levan. Galactoses, including agar, etc., is preferred.

2) Polyhydric Alcohols

Specific examples of the polyhydric alcohols, which are also called alkane polyols, include glycerol, glycitol, and ethylene glycol.

3) Polymers Represented by Formula (2)

In formula (2), D represents a repeating unit derived from an ethylenically unsaturated monomer having at least one alcoholic group; E represents a repeating unit other than D units, derived from an ethylenically unsaturated monomer; d and e each represent the weight percentage of D and E, respectively. d ranges generally from 5 to 100, preferably 20 to 100, and more preferably 40 to 100 and e ranges generally from 0 to 95, preferably 0 to 80, and more preferably 0 to 60. Examples of the ethylenically unsaturated monomer providing E include monomers that provide the above-described B and monomers represented by the above-described formula (4).

Of the compounds 3), the polymers represented by formula (2), more preferable examples are vinyl acetate/polyvinyl alcohol copolymers. The copolymerization ratio can be adjusted by the degree of saponification of polyvinyl acetate.

As to other details of the compounds represented by formula (1) or (2) and methods of polymerization for obtaining these compounds, reference can be made, for example, to Teiji Tsuruta, *Kobunshi Gosei Hanno* (revised ed.), The Nikkan Kogyo Shimbun Ltd. (1971); Takayuki Ohtsu, et al., *Kobunshi Gosei no Jikkenho,* Kagaku Dojin, pp. 124–154 (1972); JP-A-6-19029, and the articles listed below for water-soluble high polymers.

The compounds 1) to 3) described above may be used as a combination of two or more thereof, at an appropriate mixing ratio. These compounds can be added to a reaction system as they are, or in a powdered form or in a dissolved state. They may be added in the state of being dissolved in acidic, neutral, or alkaline water. For other details of the compounds 1) to 3), reference can be made to Shinji Nagatomo (ed.), *Shin.Suiyosei Polymer no Oyo to Shijyo,* C.M.C. (1988); Keiei Kaihatsu Center Shuppan-bu (ed.), *Suiyosei Kobunshi.Sui-bunsangata Jushi Sogogijutsu Shiryoshu,* Keiei Kaihatsu Center Shuppan-bu (1981); Tadanori Misawa (ed.), *Suiyosei Kobunshi,* New revised and enlarged 3rd. ed., Kagaku Kogyosha (1990); and C. A. Finch (ed.), *Polyvinyl Alcohol,* John Wiley & Sons (1992).

(III) Physical Properties of AgX Emulsion

In the above-described (1) to (4), the terminology "projected area" as used herein means a projected area of AgX emulsion grains arranged on a substrate (plate) so as not to overlap each other and with the main planes of tabular AgX grains being parallel to the substrate plane. The AgX emulsion of the present invention is one comprising at least a dispersion medium and AgX grains, in which tabular grains having a {100} face as a main plane and an aspect ratio (diameter/thickness ratio) of not less than 2 (preferably 2.0 to 100, more preferably 2.0 to 20, particularly preferably 4.0 to 20) occupy 60% or more (preferably 70 to 100%, more preferably 90 to 100%) of the total projected area.

The term "diameter" as used herein for the tabular grains means a diameter of a circle whose area is equal to the projected area of a tabular grain under electron microscopic observation. The term "thickness" means the distance between two main planes of a tabular grain. The thickness is preferably not larger than 0.5 μm, more preferably 0.03 to 0.3 μm, and further preferably 0.05 to 0.2 μm. A circle-equivalent diameter of the tabular grain (the "diameter" as described above) is preferably not larger than 10 μm, more preferably 0.2 to 5 μm. While the halogen composition of the tabular grains is not particularly limited and any composition can be used in the present invention, an $I^-$ content is preferably not more than 20 mol %, more preferably 0 to 10 mol %. The distribution of the tabular grain diameter is preferably monodisperse. A preferred degree of monodispersion is preferably 0 to 0.4, more preferably 0 to 0.3, and further preferably 0 to 0.2, in terms of the coefficient of variation of the grain diameter distribution (standard deviation/mean diameter).

The aspect ratio of the tabular grains is generally 2.0 to 100, preferably 2.0 to 20.

The terminology "main plane" as used herein denotes the largest outer surface of a tabular grain and another large outer surface parallel to the largest outer surface. Examples of the projected contour of the tabular grains (the outline shape of the edges of the plan view of a tabular grain placed on a substrate plane with its main planes parallel to the substrate, as illustrated in FIG. 1) include the followings. That is, ① a right-angled parallelogram, ② a mode that is a shape of a right-angled parallelogram that is missing one or more of its four corners non-equivalently (for details, reference can be made to Japanese patent application Nos. 4-145031 and 5-264059), ③ a mode that is a shape of a right-angled parallelogram with at least two of four sides, facing to each other, that are convexly curved (convex toward the outside), and ④ a mode of a right-angled parallelogram whose four corners are equivalently missing, provided that the ratio of the largest missing area to the smallest one of the main plane in a grain is less than 2. In addition, can be mentioned ⑤ a mode of a shape having an {n10} face between the main plane and the {100} face at an edge of the main plane, wherein n is an integer of generally 1 to 5, preferably 1. In the case of ⑤, the area ratio of the {n10} face to the total surface area of a tabular grain is preferably 0.1 to 30%, more preferably 1 to 15%. In the cases of ② and ④, the edge plane(s) on the missing part(s) is/are a {111} face and/or an {n10} face (n is as defined above). The above ① and ② are preferable modes.

The right-angled parallelogram enclosed with the {100} phases at the edges of the tabular grain, or a right-angled parallelogram formed by extending the {100} faces at the edges, has a slenderness side ratio (a ratio of the length of the long side to that of the short side) of 1 to 6, preferably 1 to 4, more preferably 1 to 3, and most preferably 1 to 2. The former right-angled parallelogram corresponds to the projected contour of the tabular grain, and the latter to a right-angled parallelogram circumscribing the {100} face of the tabular grain.

Further, in the present invention, a proportion of grains having the above-defined slenderness side ratio of less than 6 and/or crystalline grains composed of at least two of such-shaped grains being junctioned together at right angles or in parallel, is preferably not more than 18% by weight, more preferably 0 to 15% by weight, further preferably 0 to 10% by weight, and most preferably 0 to 2% by weight, based on the total AgX grains.

The halogen composition of the whole tabular grains is AgBrCl, AgBr, AgBrI, AgClI, or a mixed crystal thereof. The $I^-$ content is preferably 0 to 20 mol %, more preferably 0 to 10 mol %, and the AgCl content is preferably 0 to 50 mol %, more preferably 1 to 10 mol %.

With respect to the halogen composition distribution in individual tabular grains, JP-A-6-59360 and 5-313273, Japanese patent application Nos. 6-47991 and 5-27411 can be referred to. For example the tabular grains can have such a grain structure as illustrated in the accompanying drawings of these patent specifications, in which the white background portion and the hatched portion differ in $Br^-$ or $Cl^-$ content by generally 1 to 70 mol %, preferably 5 to 50 mol %, or in $I^-$ content by generally 0.3 to 30 mol %, preferably 1 to 20 mol %. The hatched portion in the grain structure denotes a thickness corresponding to at least 3 atomic layers. Preferably, the above-specified halogen content or thickness in the hatched portion is distributed substantially uniformly not only in an individual grain but also among grains.

In addition, grains whose surface layer has an $SCN^-$ or $I^-$ content of generally not less than 0.1 mol %, preferably 0.5 to 50 mol %, and grains whose surface layer has a $Br^-$ content of generally 1 to 100 mol %, preferably 5 to 80 mol %, are also included in embodiments of the AgX grains. The terminology "surface layer" as referred to above denotes the surface portion corresponding to 1 to 1,000 atomic layers, preferably 1 to 3 atomic layers, from the outer surface. Preferably, the above-specified content and surface layer thickness are distributed substantially uniformly not only in an individual grain surface but also among grains.

The term "substantially uniformly" as used above means that the coefficient of variation of the content (standard deviation/mean content) preferably ranges from 0 to 0.4, more preferably 0 to 0.2, and further preferably 0 to 0.1.

Additionally, the embodiment in which the distribution on the surface of grains in ununiform (i.e. the coefficient of variation is more than 0.4) is exemplified. Particularly, the embodiment that the edge portion or the corner portion of the grain and the vicinity thereof are made protuberant (upheaved) can be exemplified, and reference can be made, for example, to U.S. Pat. No. 5,275,930.

(IV) Formation of the Tabular Grains (IV)-1. Formation of Seed

The tabular grains owe their tabular form to crystal defects that enable preferential growth (crystal defects for isotropic growth) in the edge direction. Such crystal defects are formed at the time of seed formation of the tabular grains by, for example, the following four methods 1) to 4) of forming the defects.

Method 1)

$Ag^+$ and $X^-$ are added to an aqueous solution containing the compound $A^0$ and/or compound $B^0$. In this case, the compound $A^0$ and/or compound $B^0$ are adsorbed onto AgX nuclei formed, and a crystal defect is provided when $Ag^+$ and $X^-$ are further built up layers on the nuclei. In some cases, the compound $A^0$ and/or compound $B^0$ form a complex with the added $Ag^+$ or $X^-$, and a crystal defect is provided when the thus-formed complex is incorporated into the AgX nuclei.

Method 2)

First, $AgX_0$ nuclei substantially free from crystal defects are formed in an aqueous solution of a dispersion medium. Then, the compound $A^0$ and/or compound $B^0$ are added thereto and adsorbed onto the $AgX_0$ nuclei. $Ag^+$ and $X^-$ are then added thereto, and a crystal defect is provided when the added $Ag^+$ and $X^-$ are built up layers on the AgX nuclei. The term "substantially free" as used above means that the amount of defects initially present in $AgX_0$ nuclei is preferably 0 to 20%, more preferably 0 to 5%, and most preferably 0 to 1%, of the total defects formed through the seed formation step.

The compound $A^0$ and/or compound $B^0$ may be added while adding $Ag^+$ and $X^-$, or they may be added after the stop of the addition of $Ag^+$ and $X^-$. Further, after the compound $A^0$ and/or compound $B^0$ are added, $Ag^+$ and $X^-$ may be then added at the same temperature, alternatively the compound $A^0$ and/or compound $B^0$ are added, and then after the temperature is raised to by generally 3° C. or more, preferably 5 to 70° C., and more preferably 10 to 60° C., $Ag^+$ nd $X^-$ may be added. As a result, the defects can be formed by the above addition methods. Among these, the latter is preferred. These compounds can be added under the most preferable condition selected in each case.

Method 3)

At the time of formation of AgX seed, a halogen composition gap interface is introduced and formed in each nuclei, to form a crystal lattice strain, thereby forming a defect. For example, $Ag^+$ and $Xa^-$ are added to form AgXa nuclei at first. $Ag^+$ and $Xb^-$ are then added, to form (AgXa|AgXb) seed, wherein $Xa^-$ and $Xb^-$ differ in $Cl^-$, $Br^-$, or $I^-$ content by generally 10 to 100 mol %, preferably 30 to 100 mol %, and more preferably 50 to 100 mol %. $Xa^-$ and $Xb^-$ each indicate the halogen composition of a halide solution added. At least 1, preferably 1 to 5, and more preferably 2 to 4 halogen gap faces are thus formed in the seed. Such (AgXa|AgXb) can also be formed by a method comprising once forming AgXa nuclei and adding thereto $Xc^-$ alone, or both $Xc^-$ and $Agc^+$ at a molar ratio of generally ($Xc^-$>$Agc^+$), preferably ($Xc^-$>$2Agc^+$), more preferably ($Xc^-$>$5Agc^+$). This method is more preferable. The term "$Xc^-$>$2Agc^+$" as used above means that the molar amount of $Xc^-$ to be added is at least twice that of $Agc^+$. Preferably, the solubility of AgXc is 1/1.5 or less, more preferably 1/3 or less, and further preferably 1/8 or less, of that of AgXa. According to this method, halogen conversion occurs between the added $Xc^-$ and AgXa, to form the (AgXa|AgXc).

The $X^-$ can be added by a method comprising adding $Cl_2$, $Br_2$, $I_2$, or a mixture thereof, and then adding a reducing agent, to generate $X^-$. The halogen may be added in any form of gas, aqueous solution, solid, and inclusion compound. The halogen may also be fed by a mode of $X_2+X^- \rightarrow (X_3)^-$, e.g. in the form of an aqueous solution of $(I_3)^-$. The reducing agent to be added is selected from those capable of providing a more-negative standard electrode potential with reference to the standard electrode potential of $X_2$+2 electrons$\Leftrightarrow 2X^-$. Photographically inert reducing agents are preferable, with $H_2SO_3$ being more preferable. The reducing agent may be added as a mixed aqueous solution with the aforesaid carbohydrate.

In addition, use can be made of a method of adding a $Br^-$ or $I^-$ releasing agent to a reaction system, to let the agent release $Br^-$ or $I^-$. For details of this method, reference can be made to JP-A-6-19029, EP-A-0 561 415, and U.S. Pat. No. 5,061,615.

The halogen composition gap can also be introduced by a method comprising first forming AgXa nuclei and then adding fine AgXb grains, followed by ripening, to form (AgXa|AgXb), wherein Xa and Xb are as defined above. The AgXb fine grains have a grain diameter of generally not greater than 0.15 μm, preferably 0.003 to 0.07 μm, and more preferably 0.005 to 0.05 μm.

Method 4)

Besides the above, the defects can be formed by a method of adding, prior to nucleation, $I^-$ to an aqueous solution of a dispersion medium, and/or a method of adding $X^-$, which is to be added for nucleation together with $Ag^+$, in the form of a $X^-$ solution containing both $I^-$ and $Cl^-$. In the former method, $I^-$ is added in a concentration of generally $1\times10^{-5}$ to $1\times10^{-1}$ mol/l, preferably $1\times10^{-4}$ to $1\times10^{-2}$ mol/l. In the latter method, the $I^-$ content is preferably not more than 30 mol %, more preferably 0.1 to 10 mol %, and the $Cl^-$ content is preferably not less than 30 mol %, more preferably not less than 50 mol %.

In any of these methods 1) to 4), the amount of defects to be formed is preferably decided from the shape of finally obtained AgX grains so as to give the optimum amount. If the amount of the defects formed is too small, the proportion of tabular grains in number in the total AgX grains will be insufficient. If it is too large, too many defects introduced per grain result in an increase of the proportion of the number of grains having low aspect ratios. Accordingly, it is preferable to select an amount of defects to be formed such that the projected area ratio of tabular grains falls within a preferred ratio. In the case of methods 1) and 2), the amount of defects formed increases as the amount of the compound $A^0$ and/or compound $B^0$ to be added is increased, or as the concentration of gelatin is decreased, or alternatively as the adsorption force of the compound(s) is increased. In the case of method 3), the amount of defects formed increases as the gap of halogen composition is increased, or as the amount of conversion is increased, or alternatively as the amount of AgXa or AgXb to be added is increased. In the case of method 4), the amount of defects formed increases as the amount of $I^-$ is increased.

In these methods, the amount of defects formed also depends on the pH or $X^-$ concentration of the reaction system. A preferred pH value and a preferred $X^-$ concentration can be selected accordingly. Where method 3) is adopted, halogen conversion takes place preferentially at the edges and corners of AgXa nuclei, where defects are preferentially formed.

Among methods 1), 2), 3), and 4), methods 1), 2), and 3) are preferred, further methods 1) and 2) are more preferred, and method 2) is most preferred. Since method 2) effectively acts in a low pH condition (i.e. pH 1 to 6), it is advantageous for decreasing the thickness of grains. In the present specification, the term "nucleus" indicates a fine AgX grain.

(IV)-2. Ripening, Growth, Grain Formation Embodiments According to the Present Invention The above-described formation of seeds having crystal defects is preferably followed by ripening. Specifically, the temperature of the reaction system is raised by generally 5° C. or more, preferably 10 to 70° C., and more preferably 20 to 70° C., to cause Ostwald ripening, whereby non-tabular grains disappear and only tabular grains are allowed to grow. The ripening may be carried out while adding $Ag^+$ and $X^-$ at low feeding rates. The ripening may also be conducted by increasing the $X^-$ concentration or by adding an AgX solvent, to increase the solubility of AgX. The pH of the ripening system is preferably adjusted in the range generally from 1 to 11, preferably 1.7 to 9. The literature hereinafter described can be referred to regarding the AgX solvent. The AgX solvent is used in an amount of generally 0 to $10^{-1}$ mol/l, preferably 0 to $10^{-3}$ mol/l. The AgX solvent added may be deactivated after ripening. For example, $NH_3$ can be deactivated by conversion to $NH_4^+$, and a theioether compound can be deactivated by oxidation of the thioether group.

Through the ripening, the proportion of tabular grains in number is increased to preferably 1.5 times or more, more preferably 3 to 500 times, and further preferably 6 to 200 times. After the increase in number of the tabular grains, they go into the stage of growth. The modes of tabular grain formation according to the present invention are classified as follows:

(1) seed formation by method 1) or 2) in (IV)-1 (→treatment for weakening the adsorption force of the adsorbent→ripening)→growth, provided that at least one step in the above ( ) may be properly omitted; and (2) seed formation by method 3) or 4) in (IV)-1→ripening→growth. The adsorbent $A^0$ and/or $B^0$ that is (are) adsorbed by moderate adsorbing force can be added at a stage from before ripening to 5 minutes before the completion of grain growth, preferably after ripening before growth.

Treatment for weakening the adsorption force of the adsorbent is explained below. ① When the adsorbent is the compound $A^0$, the pH of the system is lowered to generally (pKa of the adsorbent $A^0$+0.5) or lower, preferably (pKa+0.2) or lower, and more preferably pKa to (pKa−4.0). ② When the adsorbent is the compound $B^0$, the pH and/or $X^-$ concentration of the reaction system a selected so as to lessen the adsorption force. In many cases, the adsorption force is made weaker as the pH is lowered or as the $X^-$ concentration is increased. The effect is believed to be attributed, for example, to a change of the alcoholic group to $—OH_2^+$ on pH reduction, and to reaction of the alcoholic group with a hydrogen halide according to the following formula: $R—OH+HX \rightarrow R—X+H_2O$. In addition, the treatments when the adsorbent is $B^0$ also include ③ addition of an oxidizing agent, such as $H_2O_2$ and $KMnO_4$, to oxidize the alcoholic group to an aldehyde or carboxylic acid group, ④ esterification of the alcoholic group, ⑤ dehydration, and ⑥ reaction with a phosphorus trihalide. For the details of these treatments, reference can be made to R. T. Morrison and R. N. Boyd, *Yuki Kagaku,* 6th ed., Ch. 6, Tokyo Kagaku Dojin (1994); and S. Patai (ed.), *The Chemistry of the Hydroxyl Group,* Interscience Publishers (1971).

Treatments that are effective on both the adsorbents $A^0$ and $B^0$ also include ⑦ addition of a dispersion medium that suppresses defect formation, for example gelatin, wherein a (gelatin weight/adsorbent weight) ratio is generally 0.1 or more, preferably 0.3 to 300, and more preferably 1 to 100; ⑧ increasing the temperature (the adsorption⇆desorption equilibrium generally shifts to the right-hand side with a temperature rise (preferably the temperature being increased by 5 to 60° C., more preferably 10 to 50° C.)), and ⑨ removal of a part or all (preferably 10 to 100%, more preferably 20 to 90%) of the adsorbent from the system by, for example, centrifugal separation or filtration (e.g. ultrafiltration). In treatment ⑨, the removal of the adsorbent is preferably after addition of the compound used in treatment ⑦, e.g. gelatin. Suitable gelatin species and other dispersion media to be used can be selected from among known photographic dispersion media by referring to the articles hereinafter listed. By carrying out these treatments, defect formation during grain growth can be avoided substantially.

It is also preferable in the present invention that defect formation be avoided substantially during grain growth according to the above mode (2). The term "substantially" as used herein means that the amount of defects that may be formed during growth is generally not more than 30%, preferably 0 to 10%, and more preferably 0 to 2%, of the amount of defects present immediately before the growth stage. It is preferable for the adsorbent to keep its capability of shape control while the grains are growing. As the adsorbing force of the adsorbent to hold onto grains weakens, it first follows that the capability of defect formation is lost. As the force is further weakened, the capability of shape control is gradually weakened, ultimately to the same level possessed by usual gelatin. Accordingly, the above-mentioned embodiment can be attained by moderately setting the degree of weakening of the adsorption force. The term "capability of shape control" as used herein designates an ability of shifting the above-described relationship of the silver potential vs. shape of AgBr grains in a grain formation system containing gelatin, to a lower side of the silver potential by generally 10 mV or more, preferably 20 to 150 mV, more preferably 30 to 120 mV, and most preferably 50 to 100 mV.

In mode (2), the adsorbent added does not act as a defect-forming agent but as a shape-controlling agent. When expressed more directly, the capability of shape control is an ability of controlling a thickness increase during growth of tabular grains to generally 80% or less, preferably 0 to 60%, and more preferably 0 to 30%, of that observed in the growth system containing no shape-controlling agent with the same conditions, except those described below. The pH of both the system containing a shape-controlling agent and the system containing no shape-controlling agent can be independently selected from 1 to 11 so as to give the optimum condition, i.e. so that the thickness increase may be inhibited the most. When the $X^-$ concentration is also varied, the $X^-$ concentration for obtaining tabular grains of a given thickness in the system containing a shape-controlling agent is generally 1.5 or more times, preferably 2 to 100 times, that in the system containing no shape-controlling agent.

Formation of tabular grains in the presence of the compound $C^0$ is described in EP-A-0 534 395 (A1). However, the compound $A^0$, having two or more molecules of the compound $C^0$ covalently bonded to each molecule of the compound $A^0$, is superior to compound $C^0$ per se in effect. This seems to be because, taking the adsorption energy of compound $C^0$ adsorbed on {100} faces of AgX grains as $EC^0$, the adsorption energy of compound $A^0$, having bonded thereto n molecules of compound $C^0$ per molecule, amounts to about $n \times EC^0$. That is, even though $EC^0$ may be small, it is considered that a desired adsorption force can be obtained almost arbitrarily by selecting the n value. A strong adsorption force can thus be secured at the time of crystal defect formation, while the adsorption force can be lessened at the time of growth by, for example, adjusting the pH to the pKa of compound $A^0$ or lower. If the pH is lowered to (pKa−1.0) or less, the adsorption force can be substantially lost. Therefore, use of the compound $A^0$ according to the present invention is advantageous in that the adsorption force can be adjusted freely over a broader range to exhibit more appreciable effects than the conventional compound $C^0$.

Figure 2:
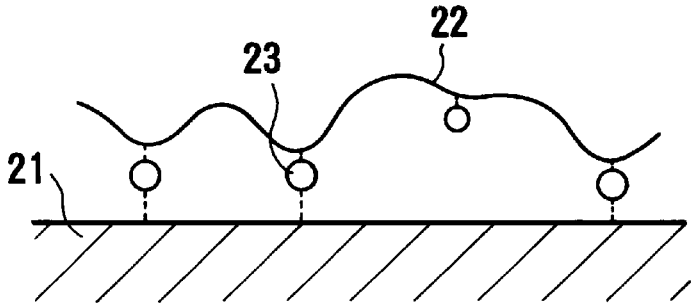
FIG. 2 is a schematic diagram illustrating an embodiment of adsorption of an adsorbent having a number of weakly adsorbable groups per molecule in the adsorbed state.

When compound $A^0$ is added during the growth step according to the above mode (2), the compound $A^0$ to be added can be designed by selecting a compound $C^0$ having weak adsorption force by nature, and also by selecting a large number as n, so that no further defect formation will occur, growth inhibition can be minimized, and the shape of growing grains can be under control, to realize a mode of the invention. These effects can be accounted for as follows. As shown in FIG. 2, since there are many adsorbable sites per one molecule, compound $A^0$ maintains the adsorbed state, thereby keeping capability of controlling grain shape. On the other hand, since the individual adsorbable sites have a weak adsorption force, adsorption and desorption are repeated frequently at each site. At the time of desorption, $Ag^+$ and $X^-$ are allowed to be built up layers. In FIG. 2, 21 denotes a surface of an AgX grain, 22 denotes a main chain of an adsorbent $A^0$, and 23 denotes a residual group of an adsorbent $C^0$ that is covalently bonded to the main chain of the adsorbent $A^0$.

On the other hand, the compound $B^0$ can also be designed so as to be adsorbed firmly on AgX grains, to form crystal defects and, at the time of grain growth, to control growth characteristics without substantially forming further defects. It has been unknown heretofore that the polyhydric alcohol compound has a defect-forming action and a shape-controlling action during growth of tabular grains. Besides, the effects of compound $B^0$ are superior to those of compound $A^0$. The adsorption force of compound $B^0$ increases as the number of alcoholic groups per molecule increases (and the molecular weight increases accordingly), or as the value $X_1$ increases. Therefore, the adsorption force can be adjusted through adjustment of these values.

With either adsorbent $A^0$ or $B^0$, the adsorption force is reduced as the ratio of non-adsorbable water-soluble functional groups per molecule increases. The non-adsorbable water-soluble functional groups help the molecules of the adsorbent swim about in the reaction system in a non-adsorbed state. The adsorbent $A^0$ and $B^0$ may be used as a mixture thereof, at an appropriate mixing ratio.

The mode of adsorption of the polyhydric alcohol compound onto the surface of AgX grains is complicated. The compound $C^0$, added at a pH of its pKa or more, is adsorbed on the $Ag^+$ sites on the surface of AgX grains, to reduce the ion conductivity ($\sigma_i$) of the AgX grains. On the other hand, adsorption of compound $B^0$ on AgX grains results in an increase of $\sigma_i$ of any of cubic AgBr grains, octahedral AgBr grains, and cubic AgCl grains. Such an adsorbent that accelerates {100} face formation with an increase in $\sigma_i$ of grains has been unknown heretofore, and this function is a new phenomenon. In particular, the $\sigma_i$ of cubic AgBr grains was found to be increased twofold or more. Accordingly, it is considered that compound $B^0$ strongly interacts also with $X^-$ of the surface of grains, to exhibit powerful shape-controlling properties. Herein, the $\sigma_i$ is measured by the dielectric loss method.

In the present invention, preferably defect formation substantially completes before the start of grain growth. A preferable amount of the silver salt added before the start of grain growth is not more than a half, more preferably not more than a quarter, of the total amount of the silver salt added through the grain formation step.

In the formation period and growth period of crystal seeds, a combination use of the adsorbent and gelatin is more preferable, as compared with a single use of the adsorbent. Publicly known gelatin can be used in an amount of preferably 0.05 to 10 g/liter, and more preferably 0.2 to 5 g/liter. The ratio (i.e. weight ratio of adsorbent/gelatin) is preferably 0.01 to 0.9, more preferably 0.03 to 0.5, and further preferably 0.06 to 0.3.

The temperature in the formation period of crystal seeds can be set at generally 10 to 90° C. On the other hand, the temperature in the crystal defect formation period of methods 1) and 2) is preferably 30 to 90° C., and more preferably 40 to 85° C. The capability of forming the crystal defect against fine AgCl grains of compound $B^0$ is maximized in the vicinity of pH 4, at a temperature ranging from 50 to 85° C. As a result, the capability decreases as the pH is lowered or increased from about 4.

(V) Other Particulars

In the present invention, the terminology "seed formation period" indicates a period from the start of AgX nucleation to the start of the temperature increase; the terminology "ripening period" indicates a period from the start of the temperature increase to the start of growth; and the terminology "growth period" indicates a period of from the start to the completion of growth. The optimum pH and $X^-$ concentration conditions during the seed formation period, ripening period, and growth period can be selected from a pH of generally 1 to 11, preferably 1.7 to 9, and an $X^-$ concentration of generally not more than $1\times10^{-0.9}$ mol/liter, preferably $1\times10^{-4}$ to $1\times10^{-1.2}$ mol/liter.

With respect to the details of oxidizing agents and reducing agents for use in the present invention, reference can be made to *Kagaku Jiten,* Tokyo Kagaku Dojin (1994), items "Sankazai" and "Kangenzai"; Japanese patent application No. 6-102485; Nippon Kagakukai (ed.), *Shin-Jikken Kagaku Koza,* Vol. 15, "Sanka to Kangen, Maruzen (1976); Minoru Imoto (ed.), *Koza Yuki Han-no Kiko,* Vol. 10, Tokyo Kagaku Dojin (1965); Yoshiro Ogata (ed.), *Yuki Kagobutsu no Sanka to Kangen,* Nankodo (1963); JP-A-61-3134; and *Kagaku Daijiten,* Kyoritsu Shuppan (1963), items "Sankazai"and "Kangenzai."

Figures 3A, 3B, 3C:
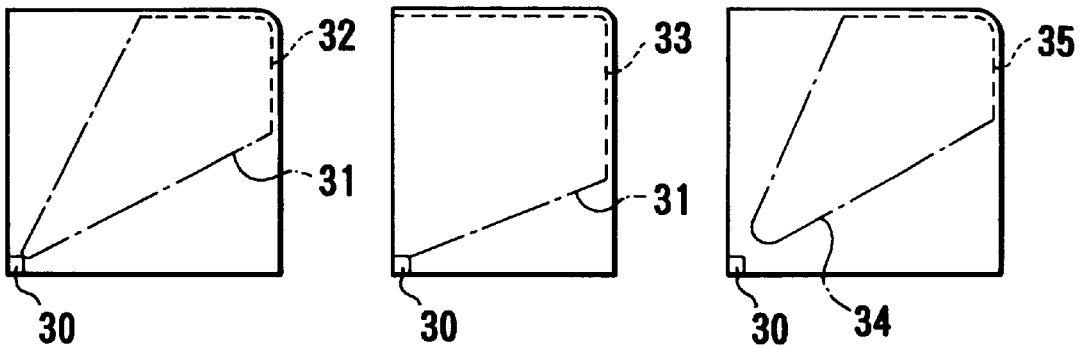
FIG. 3A, FIG. 3B, and FIG. 3C are schematic diagrams showing embodiments of dislocation lines and plane defects (face defects) of the tabular grains, respectively.

The characteristic of the defects are explained below. Most of the defects are considered to be plane defects in the planes (faces) parallel to the main planes. That can be seen from direct observation of tabular grains under a transmission electron microscope at −100° C. or lower, which reveals lines recognized as dislocation lines and a step at the edge surface in agreement with the dislocation lines, as shown in FIGS. 3A, 3B and 3C, which illustrate typical examples of such plane defects. In FIGS. 3A, 3B and 3C, 30 indicates a portion corresponding to a nucleus, 31 and 34 each indicate a dislocation line, and 32, 33, and 35 each indicate a step line. In FIG. 3A, the edge surface between two dislocation lines 31 has a step line 32 and exhibits a growth-accelerating action. In FIG. 3B, step line 33 of the edge surface has a growth-accelerating action. When grains are allowed to grow at a high temperature, such dislocation lines are observed to move little by little in the grain, like, for example, dislocation line 34 shown in FIG. 3C. In the present invention, preferably tabular grains having two dislocation lines extending from the corner on the surface corresponding to seed of the grain at an acute angle formed by the two dislocation lines, as shown in FIG. 3A, occupy generally 20% or more, preferably 30 to 100%, and more preferably 40 to 80% of the projected area of the total tabular grains. The seed corresponds to those formed during seed formation.

When such a plane defect is formed in the tabular grain by forming a (AgCl|AgI|AgCl) gap seed or by $I^-$ conversion of AgCl nuclei according to the method 3) described in (IV)-1, the step line 33 in FIGS. 3A, 3B and 3C tends to become long.

After the formation of tabular grains, it is possible to cover the entire surface of the grains with an AgX layer of different halogen composition that is different from the halogen composition of the grain surface. The thickness of the AgX layer is generally a single atomic layer or more, preferably 5 to $10^3$ atomic layers. Further, it is also possible to cause halogen conversion on the grain surface by addition, after the formation of tabular grains, of a thiocyanate (rhodanate) or halide solution. The amount of thiocyanate or halide to be added is generally 0.1 to 1000 mol per mole of the surfacing halogen atoms of all the grains. The halide to be added may be $I^-$, $Br^-$, or a mixed halide of two or more of $I^-$, $Br^-$, and $Cl^-$ (the mixing ratio is arbitrary).

As a dispersion medium used during grain formation, gelatin having a methionine content of 0 to 40 $\mu$mol/g, and a modified gelatin (e.g. phthalated gelatin) described in Japanese Patent Application No. 6-184128, can be preferably used. It can be used in a proportion of generally 20 to 100% by weight, preferably 50 to 100% by weight, and more preferably 80 to 100% by weight, based on the total dispersion medium.

Further, preferably the treatment that the ability of a dispersion medium for forming complex with $Ag^+$ from after $AgX^0$ nucleus formation to before 5 minutes of the growth completion is decreased to 1 to 90% of the original ability, is carried out. Particularly, preferably the treatment that the complex-forming ability of 1.0 wt % aqueous solution of dispersion medium having a pH of 2 to 4 is decreased to 3 to 70% of the original ability, is carried out. Specifically, preferably an oxidizing agent is added, and particularly $H_2O_2$ is added. With respect to details of the oxidizing agent, reference can be made to JP-A-7-311428.

In the present invention, the tabular grains are preferably prepared in the presence of the compound $A^0$ and/or the compound $B^0$, and the concentration of the compound(s) that is (are) added is one that results in the equilibrium crystal habit potential-shifted amount being generally 10 mV or more, preferably 20 to 150 mV, more preferably 30 to 120 mV, and most preferably 50 to 100 mV.

In the method 2) described in (IV)-1 above, the $AgX^0$ nuclei are substantially free from defects, which can be confirmed as follows. $Ag^+$ and $X^-$ are added to the $AgX^0$ nuclei at a low temperature (25 to 40° C.) at feeding rates that do not cause Ostwald ripening or generation of new nuclei, to allow all the nuclei to grow to a diameter of about 0.3 μm in the absence of an AgX solvent. A transmission electron microscope image (a TEM image) of a replica film of the grains thus formed is observed, to obtain the proportion of the tabular grains. Tabular grains with an increased aspect ratio would be obtained by using the above-described gelatin species and allowing the nuclei to grow under a lower degree of supersaturation.

In one mode of the present invention, a silver halide having an epitaxial junction that form a protrusion at the particular site on the surface of the grain can be used, as provided by Maskasky in U.S. Pat. No. 4,435,501 (hereinafter referred to as "Maskasky"). Maskasky showed that silver salt epitaxy can be directed to selected sites of host grains, typical examples of which are edges and/or corners, by a site director, such as iodide ions, aminoazaindenes, and selected spectral sensitizing dyes, each of which is adsorbed on the host tabular grain surface. In accordance with the composition and the site of the silver salt epitaxy, a remarkable increase in sensitivity was observed. Maskasky also teaches that a compound for denaturantion can be doped into (built in) host tabular grains or into halide salt epitaxy, if necessary.

The tabular grains whose main plane is a {100} face for use in the present invention may have an epitaxially deposited silver halide forming at least one protrusion at a selected site on the grain surface. The protrusion exhibits higher overall solubility than the silver halide forming at least those portions of the tabular grains that serve as epitaxial deposition host sites, i.e. that form an epitaxial junction with the silver halide being deposited. The term "higher overall solubility" herein used means that the average solubility of the silver halide forming the protrusion must be higher than that of the silver halide forming the host portions of the tabular grains. The solubility products of AgCl, AgBr, and AgI in water at a temperature ranging from 0 to 100° C., are reported in Table 1.4, page 6, Mees, *The Theory of the Photographic Process,* Third Ed., Macmillan, New York (1966). For example, at 40° C., a common emulsion preparation temperature, the solubility product of AgCl is $6.22\times10^{-10}$, of AgBr it is $2.44\times10^{-12}$, and of AgI it is $6.95\times10^{-16}$. Because of the large difference of silver halide solubilities, it is apparent that the epitaxially deposited silver halide must, in the overwhelming majority of instances, have a lower iodide concentration than the portions of the host tabular grains on which epitaxial deposition occurs. Due to the requirement that the epitaxially deposited protrusions have to exhibit a higher overall solubility than at least those portions of the ultrathin tabular grains on which the protrusions are deposited, substitution of halide ions from the {100} tabular grains reduces, thereby avoiding degradation of the tabular grains in its shape.

In the practice of the present invention, it is contemplated that the silver halide protrusions will in all instances be precipitated to contain generally at least a 10%, preferably at least a 15%, and optimally at least a 20% higher chloride concentration than the host {100} tabular grains. It would be more precise to mention that the chloride concentration in the silver halide protrusions to the chloride ion concentration in the epitaxial junction forming portions of the tabular grains is preferably rendered higher, as described above.

In the present invention, further improvement in photographic speed can be realized by adding iodide ions or bromide ions along with silver ions and chloride ions to the {100} tabular grain emulsion at the same time of performing the epitaxial deposition. The iodide ion concentration is preferably 1.0 mol % or more, based on the silver. The bromide ion concentration is preferably 1 to 50 mol %. The particularly preferable concentration of bromide ions is about 13 mol % and about 40 mol %.

It is believed that the highest levels of photographic performance are realized when the silver halide epitaxy contains both (1) the large difference in chloride concentrations between the host {100} tabular grains and the epitaxially deposited protrusions noted above, and (2) the elevated level of iodide inclusion amount in the face-centered cubic crystal lattice structure of the protrusions.

As preferable techniques for chemical sensitization and spectral sensitization, those described by Maskasky can be used. With respect to the amount of epitaxy deposition at this time, it is contemplated to restrict silver halide epitaxy generally to less than 50%, preferably to less than 30%, more preferably to less than 10%, and most preferably to less than 4% of the {100} tabular grain surface area. The minimum amount of the silver halide epitaxy is 0.2 mol %.

Maskasky teaches various techniques for restricting the surface area coverage of the host tabular grains by silver halide epitaxy that can be applied in forming the emulsions of the present invention. Maskasky teaches employing spectral sensitizing dyes that are in their aggregated form of adsorption onto the tabular grain surfaces and that are capable of directing silver halide epitaxy to the edges or corners of the tabular grains. For the {100} tabular grains for use in the present invention, J-aggregate dyes can also be used as a site director. Cyanine dyes constitute a preferable class of J-aggregate dyes. Further, also preferably, prior to adding these dyes, iodide ions are added in an amount of about 0.1 to about 2 mol %, based on the Ag amount of the host grains.

In the present invention, a dopant may be built in the {100} host tabular grains, or in the silver halide epitaxy. As employed in the specification, the term "dopant" refers to a material other than a silver or halide ion contained within the face-centered cubic crystal lattice structure of the silver halide.

The dopants for use in the present invention are described in detail in JP-A-8-101474. That is, a dopant that can serve as a shallow electron trap, is effective. It is contemplated to introduce within the face-centered cubic crystal lattice, shallow electron traps that contribute to utilizing photoelectrons for latent image formation with greater efficiency. Herein, the term "shallow electron trap" means a trap that is shallow in energy. It traps an electron temporarily but does not permanently trap the electron. For a dopant to be useful in forming a shallow electron trap, it must satisfy the following criteria:

(1) HOMO must be filled, and (2) LUMO must be at a higher energy level than the lowest energy level conduction band of the silver halide crystal lattice.

In one preferable mode, it is contemplated to employ, as a dopant, a hexa-coordinate complex satisfying the formula:

$$[ML_6]_n \qquad \text{(IV)}$$

wherein M represents a filled-frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$, or $Pt^{+4}$; $L_6$ represents six coordinate complex ligands, which can be independently selected, provided that at least four of the ligands are anionic ligands and at least one (preferably at least 3 and optimally at least 4) of the ligands is more electronegative than any halide ligand; and n is −2, −3, or −4.

Specific examples of dopants capable of providing shallow electron traps are shown below:

$[Fe(CN)_6]_{-4}$
$[Ru(CN)_6]_{-4}$
$[Os(CN)_6]_{-4}$
$[Rh(CN)_6]_{-3}$
$[Ir(CN)_6]_{-3}$
$[Fe(pyrazine)(CN)_5]_{-4}$
$[RuCl(CN)_5]_{-4}$
$[OsBr(CN)_5]_{-4}$
$[RhF(CN)_5]_{-3}$
$[IrBr(CN)_5]_{-3}$
$[FeCO(CN)_5]_{-3}$
$[RuF_2(CN)_4]_{-4}$
$[OsCl_2(CN)_4]_{-4}$
$[RhI_2(CN)_4]_{-3}$
$[IrBr_2(CN)_4]_{-3}$
$[Ru(CN)_5(OCN)]_{-4}$
$[Ru(CN)_5(N_3)]_{-4}$
$[Os(CN)_5(SCN)]_{-4}$
$[Rh(CN)_5(SeCN)]_{-3}$
$[Ir(CN)_5(HOH)]_{-2}$
$[Fe(CN)_3Cl_3)]_{-3}$
$[Ru(CO)_2(CN)_4]_{-1}$
$[Os(CN)Cl_5]_{-4}$
$[Co(CN)_6]_{-3}$
$[Ir(CN)_4(oxalate)]_{-3}$
$[In(NCS)_6]_{-3}$
$[Ga(NCS)_6]_{-3}$ It is additionally contemplated to employ oligomeric coordinate complexes to increase speed, as taught by Evans et al. in U.S. Pat. No. 5,024,931. The dopants are effective in conventional concentrations, which concentrations are based on the total silver, including both the silver in the tabular grains and the silver in the protrusions. Generally, shallow electron trap-forming dopants are contemplated to be incorporated in concentrations of at least $1\times10^{-6}$ mol per mol of silver up to their solubility limit, typically up to about $5\times10^{-4}$ mol per mol of silver. Preferable concentrations are in the range of from about $10^{-5}$ to $10^{-4}$ mol per mol of silver. Further, locating the dopant near the site of latent image formation is preferable, to increase the effectiveness of the dopant.

Silver halide epitaxy can by itself increase photographic speed (sensitivity) to levels comparable to those obtained by substantially optimum chemical sensitization with sulfur and/or gold. Additional increases in photographic speed can be realized when the tabular grains with the silver halide epitaxy deposited thereon are additionally chemically sensitized with a conventional chalcogen (i.e. sulfur, selenium, or tellurium) sensitizer or a noble metal (e.g. gold) sensitizer. These conventional approaches to chemical sensitization that can be applied to silver halide epitaxy sensitization are described in *Research Disclosure,* December 1989, Item 308119, Section III, "Chemical sensitization". Kofron et al. illustrate the application of these sensitizations to tabular grain emulsions.

A particularly preferable approach to silver halide epitaxy sensitization employs a sulfur-containing ripening agent in combination with chalcogen (typically sulfur) and noble metal (typically gold) chemical sensitizers. Contemplated sulfur-containing ripening agents include thioethers, such as the thioethers illustrated by McBride in U.S. Pat. No. 3,271,157, Jones in U.S. Pat. No. 3,574,628, and Rosencrants et al. in U.S. Pat. No. 3,737,313. Preferable sulfur-containing ripening agents are thiocyanates, illustrated by Nietz in U.S. Pat. No. 2,222,264, Lowe et al. in U.S. Pat. No. 2,448,534 and Illingsworth in U.S. Pat. No. 3,320,069. A preferable class of middle chalcogen sensitizers is tetrasubstituted middle chalcogen ureas of the type disclosed by Herz et al. in U.S. Pat. Nos. 4,749,646 and 4,810,626. Preferable compounds include those represented by the following formula:

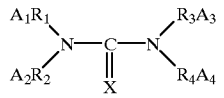

wherein, X is sulfur, selenium, or tellurium; $R_1$, $R_2$, $R_3$, and $R_4$ each independently represent an alkylene, cycloalkylene, arylene, aralkylene, or heterocyclic arylene group, or, taken together with the nitrogen atom to which they are bonded, $R_1$ and $R_2$, or $R_3$ and $R_4$, may complete a 5- to 7-membered heterocyclic ring; and $A_1$, $A_2$, $A_3$, and $A_4$ each independently represent hydrogen or a group comprising an acidic group, with the proviso that at least one of $A_1R_1$ , $A_2r_2$, $A_3R_3$, and $A_4R_4$ contains an acidic group bonded to the urea nitrogen via a carbon chain containing from 1 to 6 carbon atoms.

X is preferably sulfur, and $A_1R_1$ to $A_4R_4$ are preferably methyl or carboxymethyl, in which the carboxy group can be in the acid or salt form. A particularly preferable tetrasubstituted thiourea sensitizer is 1,3-dicarboxymethyl-1,3-dimethylthiourea. Preferable gold sensitizers are the gold (I) compounds disclosed by Deaton in U.S. Pat. No. 5,049,485. These compounds include those represented by the following formula:

$$AuL_2^+X^- \text{ or } AuL(L1)^+X^- \quad \text{(VI)}$$

wherein L is a mesoionic compound, X is an anion, and L1 is a Lewis acid donor.

Kofron et al. disclose advantages for "dyes in the finish sensitizations," which are those that introduce the spectral sensitizing dye into the emulsion prior to the heating step (finish) that results in chemical sensitization. Dyes in the finish sensitizations are particularly advantageous in the practice of the present invention in which a spectral sensitizing dye is adsorbed to the surfaces of the tabular grains, to act as a site director for silver halide epitaxial deposition. Maskasky-I teaches the use of J-aggregating spectral sensitizing dyes, particularly green- and red-absorbing cyanine dyes, as site directors. These dyes are present in the emulsion prior to the chemical sensitizing finishing step. When the spectral sensitizing dye present in the finish is not relied upon as a site director for the silver halide epitaxy, a much broader range of spectral sensitizing dyes can be used. The spectral sensitizing dyes disclosed by Kofron et al., particularly the blue-spectral sensitizing dyes, shown by structure, and their longer methine chain analogs, that exhibit absorption maxima in the green and red portions of the spectrum, are particularly preferable for incorporation in the {100} tabular grain emulsions of the present invention. The selection of J-aggregating blue-absorbing spectral sensitizing dyes for use as site directors is specifically contemplated. A general summary of useful spectral sensitizing dyes is provided in *Research Disclosure,* December 1989, Item 308119, Section IV. Spectral sensitization and desensitization, A. Spectral sensitizing dyes".

While, in one particularly preferable embodiment of the present invention, the spectral sensitizing dye can act also as a site director and/or can be present during the finish, the only required function that a spectral sensitizing dye must perform in the emulsions of the present invention is to increase the sensitivity of the emulsion to at least one region of the spectrum. Hence, the spectral sensitizing dye can, if desired, be added to {100} tabular grains according to the present invention after chemical sensitization has been completed.

It is suitable that the light-sensitive material of the present invention is provided with at least one blue-sensitive silver halide emulsion layer, at least one green-sensitive silver halide emulsion layer, and at least one red-sensitive silver halide emulsion layer on a support, and there is no particular restrictions on the number and order of the silver halide emulsion layers and the nonphotosensitive layers. A typical example is a silver halide photographic light-sensitive material having on a support at least one photosensitive layer that comprises a plurality of silver halide emulsion layers whose color sensitivities are substantially identical but whose sensitivities are different, the photosensitive layer being a unit photosensitive layer having color sensitivity to any of blue light, green light, and red light, and in a multilayer silver halide color photographic light-sensitive material, the arrangement of the unit photosensitive layers is generally such that a red-sensitive layer, a green-sensitive layer, and a blue-sensitive layer in the order stated from the support side are placed. However, the above order may be reversed according to the purpose and such an order is possible that layers having the same color sensitivity have a layer different in color sensitivity therefrom between them.

Nonphotosensitive layers such as various intermediate layers may be placed between, on top of, or under the above-mentioned silver halide photosensitive layers.

The intermediate layer may contain, for example, couplers and DIR compounds, as described in JP-A-61-43748, 59-113438, 59-11340, 61-20037, and 61-20038, and may also contain a color-mixing inhibitor as generally used.

Each of the silver halide emulsion layers constituting unit photosensitive layers respectively can preferably take a two-layer constitution comprising a high-sensitive emulsion layer and a low-sensitive emulsion layer, as described in West Germany Patent No. 1 121 470 or GB-923 045. Generally, they are preferably arranged such that the sensitivities are decreased toward the support and each nonphotosensitive layer may be placed between the silver halide emulsion layers. As described, for example, in JP-A-57-112751, 62-200350, 62-206541, and 62-206543, a low-sensitive emulsion layer may be placed away from the support and a high-sensitive emulsion layer may be placed nearer to the support.

A specific example of the order includes an order of a low-sensitive blue-sensitive layer (BL)/high-sensitive blue-sensitive layer (BH)/high-sensitive green-sensitive layer (GH)/low-sensitive green-sensitive layer (GL)/high-sensitive red-sensitive layer (RH)/low-sensitive red-sensitive layer (RL), or an order of BH/BL/GL/GH/RH/RL, or an order of BH/BL/GH/GL/RL/RH stated from the side away from the support.

As described in JP-B-55-34932, an order of a blue-sensitive layer/GH/RH/GL/RL stated from the side away from the support is also possible. Further as described in JP-A-56-25738 and 62-63936, an order of a blue-sensitive layer/GL/RL/GH/RH stated from the side away from the support is also possible.

Further as described in JP-B-49-15495, an arrangement is possible wherein the uppermost layer is a silver halide emulsion layer highest in sensitivity, the intermediate layer is a silver halide emulsion layer lower in sensitivity than that of the uppermost layer, the lower layer is a silver halide emulsion layer further lower in sensitivity than that of the intermediate layer so that the three layers different in sensitivity may be arranged with the sensitivities successively lowered toward the support. Even in such a constitution comprising three layers different in sensitivity, an order of a medium-sensitive emulsion layer/high-sensitive emulsion layer/low-sensitive emulsion layer stated from the side away from the support may be taken in layers identical in color sensitivity as described in JP-A-59-202464.

Further, for example, an order of a high-sensitive emulsion layer/low-sensitive emulsion layer/medium-sensitive emulsion layer or an order of a low-sensitive emulsion layer/medium-sensitive emulsion layer/high-sensitive emulsion layer can be taken. In the case of four layers or more layers, the arrangement can be varied as above.

In the most preferable mode of the layer constitution, the present invention is directed to a silver halide color photographic light-sensitive material comprising a blue-sensitive emulsion layer, a green-sensitive emulsion layer, and a red-sensitive emulsion layer, provided on a support, wherein at least one of these color-sensitive emulsion layers comprises a color-sensitive layer unit that is composed of at least two light-sensitive layers each having different sensitivity; and wherein, of the color-sensitive layer unit, a layer having the lowest sensitivity contains a tabular grain emulsion of the present invention whose main planes each have a {100} face, and a layer having the highest sensitivity contains an emulsion comprising light-sensitive silver halide tabular grains having a {111} face as a main plane and an aspect ratio of not less than 2. According to the above, a silver halide color photographic light-sensitive material excellent in the ratio of sensitivity/image quality can be obtained.

A mixture (blend) of the AgX emulsion of the present invention and one or more of other AgX emulsions, or a mixture of two or more AgX emulsions of the present invention differing in grain size, may be used. The mixing molar ratio of guest AgX emulsion to total mixed AgX emulsion can preferably be selected from the range of from 0.99 to 0.01 so as to give the best results. The additives that can be added to the emulsion of the present invention during the period from grain formation to coating, are not particularly limited in kind and amount, and any known photographic additives may be used in their optimum amounts. Examples of useful additives include AgX solvents, dopants to AgX grains (e.g. the group VIII noble metal compounds, other metal compounds, chalcogen compounds, thiocyanides), dispersion media, antifoggants, sensitizing dyes (e.g. blue-, green-, red-, infra-red-, panchromatic, or orthochromatic sensitizing dyes), supersensitizers, chemical sensitizers (e.g. sulfur, selenium, tellurium, gold, or the group VIII noble metal compounds, phosphorus compounds, rhodan compounds, reduction sensitizing agents, used either alone or as a combination of two or more kinds of these compounds), fogging (nucleating) agents, emulsion precipitants, surfactants, hardeners, dyes, colored image-forming agents, additives for color photography, soluble silver salts, latent image stabilizers, developing agents (e.g. hydroquinone-series compounds), pressure-induced desensitization-preventing agents, matting agents, antistatic agents, and dimensional stabilizers.

The AgX emulsion prepared by the process according to the present invention is applicable to any kind of known photographic light-sensitive materials, such as black-and white silver halide photographic light-sensitive materials, e.g. X-ray films, printing films, photographic papers, negative films, microfilms, direct positive light-sensitive materials, and ultrafine-grain dry plates (e.g. photomasks for LSI, shadow masks, masks for liquid crystals); and color photographic light-sensitive materials, e.g. negative films, photographic papers, reversal films, direct positive color light-sensitive materials, and light-sensitive materials for the silver dye bleaching process; in addition, diffusion transfer light-sensitive materials, e.g. color diffusion transfer elements and silver salt diffusion transfer elements; heat-development black-and-white or color light-sensitive materials; high-density digital recording materials, and light-sensitive materials for holography. The amount of silver coated can be preferably selected from the value of 0.01 $g/m^2$ or more.

Methods for preparing AgX emulsions (grain formation, desalting, chemical sensitization, spectral sensitization, addition of photographic additives, and the like) and equipment therefore, structures of AgX grains, supports, subbing layers, surface protective layers, the constitution of the photographic materials (e.g. layer structure, silver/color former molar ratio, and silver ratio among multiple layers), product forms, methods for storing products, emulsification and dispersion of photographic additives, exposure, development, and the like are not limited, and all the techniques and embodiments that have been or will be known can be used. For detailed information, reference can be made to *Research Disclosure,* Vol. 176 (Item 17643) (December, 1978); ibid, Vol. 307 (Item 307105, November, 1989); Duffin, *Photographic Emulsion Chemistry,* Focal Press, New York (1966); E. J. Birr, *Stabilization of Photographic Silver Halide Emulsion,* Focal Press, London (1974); T. H. James (ed.), *The Theory of Photographic Process,* 4th Ed., Macmillan, New York (1977); P. Glafkides, *Chemie et Physique Photoqraphique,* 5th Ed., Edition del, Usine Nouvelle, Paris (1987); ibid, 2nd Ed., Poul Montel, Paris (1957); V. L. Zelikman et al., *Making and Coating Photographic Emulsion,* Focal Press (1964); K. R. Hollister, *Journal of Imaging Science,* Vol. 31, pp. 148–156 (1987); J. E. Maskasky, ibid, Vol. 30, pp. 247–254 (1986); ibid, Vol. 32, pp. 160–177 (1988); ibid, Vol. 33, pp. 10–13 (1989); H. Frieser et al. (ed.), *Die Grundlagen Der Photographischen Prozesse Mit Silverhalogeniden,* Akademische Velaggesellschaft, Frankfurt (1968); *Nikkakyo Geppo,* issue of December, 1984, pp. 18–27; *Nihon Shashin Gakkaishi,* Vol. 49, pp. 7–12 (1986); ibid, Vol. 52, pp. 144–166 (1989); ibid, Vol. 52, pp. 41–48 (1989); JP-A-58-113926, 58-113927, 58-113928, 59-90841, 58-11936, 62-99751, 60-143331, 60-143332, 61-14630, 62-6251, 1-13541, 2-838, 2-146033, 3-155539, 3-200952, 3-246534, 4-34544, 2-28638, 4-109240, 2-73346, 4-193336, 8-76306, and other Japanese, U.S., European, and world patents relating to the AgX photographic field; *Journal of Imaging Science, Journal of Photographic Science, Photographic Science and Engineering, Nihon Shashin Gakkaishi;* the abstracts of lectures at Nihon Shashin Gakkai, International Congress of Photographic Science, and The International East-West Symposium on the Factors Influencing Photographic Sensitivity; and Japanese Patent Application No. 6-104065 and JP-A-7-181620.

The emulsion of the present invention can be preferably used as constituent emulsions of coated samples described in Examples of JP-A-62-269958, 62-266538, 63-220238, 63-305343, 59-142539, 62-253159, 1-131541, 1-297649, 2-42, 1-158429, 3-226730, 4-151649, and 6-27590, and EP-A-0 508 398 (A1).

A silver halide emulsion of the present invention can provide high sensitivity and high image quality. Further, silver halide color photographic light-sensitive materials utilizing the above silver halide emulsion can also exhibit excellent effects in terms of image formation with high sensitivity and high image quality, and moreover with stable and high image quality, independently of the change of processing conditions, such as pH at the time of processing.

The present invention will now be described in more detail with reference to the following examples, but the invention is not limited to the examples.

EXAMPLES

Example 1

(1) Preparation of Emulsion

Preparation of Emulsion-1

To 1.4 liters of a 1.0 wt % gelatin solution containing 0.08 M potassium bromide, 0.5 M silver nitrate solution and 0.5 M potassium bromide solution were added, with stirring of each at a rate of 15 ml/30 sec according to a double jet process with the temperature maintained at 30° C. After the addition, the mixture was heated to 75° C. Then, 105 ml of 1.0 M silver nitrate solution was gradually added thereto, followed by addition of $NH_4OH$, and the reaction mixture was kept at pH 9.5 for 15 minutes. After that, the pH was lowered to the original level, and then a silver nitrate solution containing 150 g of silver nitrate was added thereto with an accelerated feeding rate (the final feeding rate was 19 times the initial feeding rate), over a period of 120 minutes. During this procedure, KBr solution was added while maintaining pBr=2.55.

After that, the resulting emulsion was cooled down to 35° C. and washed with water according to a conventional flocculation, and a gelatin solution was added thereto, to redisperse the emulsion. The emulsion was adjusted to a pH of 6.5 and a pAg of 8.6 at 40° C.

A part of the obtained emulsion was sampled, and a TEM image [a transmission-type electron microscope photographic image] of the replica of the emulsion grains was observed. Observation of the TEM image revealed that 94% of the total projected area of all the AgX grains (hereinafter abbreviated as TPA) comprised tabular grains having a {111} face as a main plane and having an aspect ratio of 3 or more. The tabular grains had an average diameter of 1.4 μm, an average aspect ratio of 5.9, and a coefficient of variation of diameter distribution (standard deviation of distribution/ mean diameter) (hereinafter abbreviated as C.V.) of 0.19.

Preparation of Emulsion-2

In a reaction vessel was put an aqueous gelatin solution-4 (containing 25 g of gelatin and 0.11 g of NaCl in 1.2 liters of water; adjusted to pH 3.9 with an aqueous solution of $HNO_3$), and 8.0 ml of $AgNO_3$-1 solution (10 g $AgNO_3$/liter) was added thereto over 2 seconds, with stirring with the temperature kept at 40° C. Five minutes later, X-41 solution (140 g of KBr/liter) and Ag-41 solution (200 g of $AgNO_3$/liter) were added almost simultaneously, each at a rate of 50 ml/min, over 1 minute. However, the start of addition of X-41 solution preceded the start of addition of Ag-41 solution by 1 second. One minute after completion of the addition, the emulsion was adjusted to pH 5.5 by addition of an aqueous solution of NaOH. Further, an aqueous solution of polyvinyl alcohol [5 g of PV-1 in 50 ml of $H_2O$] was added thereto, the silver potential was set at 50 mV, and the temperature was raised to 75° C. After the temperature increase, the silver potential was again adjusted to 50 mV. After ripening for 30 minutes, Ag-42 solution (100 g of $AgNO_3$/liter) and X-42 solution (71 g of KBr/liter) were added thereto, while maintaining the silver potential at 50 mV with the initial feeding rate of Ag-42 solution of 5 ml/min and a linear acceleration of feeding rate of 0.05 ml/min, over 30 minutes. Three minutes later, a precipitant was added, the temperature was lowered to 30° C., and the pH was adjusted to 4.0, to precipitate the emulsion. The precipitated emulsion was washed with water, again heated to 38° C., and re-dispersed in an aqueous solution of gelatin. TEM observation of a replica of the thus-obtained emulsion grains revealed that 92% of the TPA was occupied by tabular grains whose main plane was a {100} face and whose projected contour was a right-angled parallelogram with 1 or 2 corners among 4 corners broken off. The average corner missing was about 10% of edge length. The edge surface at the missing corner(s) was a {110} face. The tabular grains had an average diameter of 1.4 μm, an average aspect ratio of 6.0, and a C.V. of 0.21.

Emulsion-2 indicates tabular grains having a high AgBr content in which crystal defects were formed by the method 3) in (IV)-1, and the grains were allowed to grow in the presence of compound $B^0$ under a high $X^-$concentration condition.

Preparation of Emulsion-3

A 0.5 mol sample of Emulsion-1 was melted at 40° C., and its pBr was adjusted to ca. 4 with a simultaneous addition of $AgNO_3$ and KI solutions in such a ratio that the small amount of silver halide precipitated during this adjustment was 12% I. Then, 2 M % NaCl (based on the original amount of {111} host grains) was added, followed by addition of a spectral sensitizing dye, after which 6 M % silver iodobromochloride epitaxy was formed by the addition order set forth below, to obtain Emulsion-3. 2.52 M % $Cl^-$ added as $CaCl_2$, 2.52 M % $Br^-$ added as NaBr, 0.96 M % $I^-$ added as a suspension of AgI (Lippmann), and 5.04 M % $AgNO_3$.

The sensitizing dye for use in this preparation was S-10.

S-10

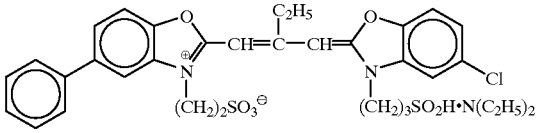

Preparation of Emulsion-4

0.5 ml of Emulsion-2 was sampled, and then in the same manner as in Emulsion-3, 6 M % of silver iodobromochloride epitaxy was formed on {100} host grains, to obtain Emulsion-4.

Preparation of Emulsions-5 to -10

In accordance with the preparation procedures of Emulsions 1 to 4, 440 mppm of $K_4Ru(CN)_6$ was added to the system at various timings, to obtain Emulsions-5 to -10.

To obtain Emulsion-5, $K_4Ru(CN)_6$ was added to the system at the time when 70% of the total Ag amount necessary to obtain Emulsion-1 was added.

To obtain Emulsion-6, $K_4Ru(CN)_6$ was added to the system at the time when 70% of the total Ag amount necessary to obtain Emulsion-2 was added.

To obtain Emulsion-7, $K_4Ru(CN)_6$ was added to the system at the time when 70% of the total Ag amount necessary to obtain host grains of Emulsion-3 was added.

To obtain Emulsion-8, $K_4Ru(CN)_6$ was added to the system at the time after the addition of NaBr was completed, but prior to the addition of $AgNO_3$ during the introduction period of silver iodobromochloride epitaxy of Emulsion-3.

To obtain Emulsion-9, $K_4Ru(CN)_6$ was added to the system at the time when 70% of the total Ag amount necessary to obtain host grains of Emulsion-4 was added.

To obtain Emulsion-10, $K_4Ru(CN)_6$ was added to the system at the time after the addition of NaBr was completed, but prior to the addition of $AgNO_3$ during the introduction period of silver iodobromochloride epitaxy of Emulsion-4.

Chemical Sensitizations

To each of Emulsions-1 to -10, were added 0.75 mg of 4,4'-phenyldisulfidediacetoanilide, a sensitizing dye (when silver halide epitaxy existed, an amount, from which the amount of the sensitizing dye to be used during the introduction period of the epitaxy was deducted, was employed), 60 mg/Ag mol of NaSCN, Sensitizer 1 (sulfur sensitizer), Sensitizer 2 (gold sensitizer), 5.72 mg/Ag mol of APMT, and 3.99 mg/Ag mol of 3-methyl-1,3-benzothiazolium iodide, and the resulting mixture was heated at 50° C. for the optimum period of time, to complete the sensitization. After cooling-down to 40° C., 114.35 mg/Ag mol of additional APMT was added.

(2) Preparation of Coated Samples and their Evaluation

To each of the emulsions-1 to -10 obtained in (1), were added a dodecylbenzenesulfonate, as a coating auxiliary, a p-vinylbenzenesulfonate, as a thickener, and a vinylsulfon-series compound, as a hardener, to prepare each emulsion coating solution. Then, each of the coating solutions was coated uniformly on a polyester base coated with an undercoat, and then a surface protective layer mainly made of an aqueous gelatin solution was coated on the coated base, to prepare Coated Samples 1 to 10, respectively. The coated amount of silver of each of Samples 1 to 10 was 3.0 $g/m^2$, the coated amount of the gelatin in the protective layer was 1.3 $g/m^2$, and the coated amount of the gelatin in the emulsion layer was 2.7 $g/m^2$.

To evaluate the thus-obtained coated samples, the following experiment was carried out:

① Photographic property; a test piece of each of Coated Samples 1 to 10 was subjected to a wedge exposure for a exposure time of 1/100 sec, with the exposure amount being 50 CMS; it was subjected to development treatment at 20° C. for 4 min, with a processing solution having the below-shown composition; and it was fixed, washed with water, dried, and subjected to sensitometry. Then, in each test piece's sensitometry, the sensitivity was measured, from the reciprocal of the exposure amount giving a density of fog+0.1.

② Suppression of dependency on the processing solution pH; two strips each of Coated Samples 1 to 10 were prepared. One of such strips was processed at a pH that was 0.5 higher than the standard formula of the processing solution shown below, while the other was processed at a pH that was 0.5 lower than the standard formula, and each sample was subjected to sensitometry in the same manner as in ①. The value (%) of [(a difference in sensitivity between the two processings)/(the sensitivity of ①)]×100 was measured, to evaluate suppression of dependency on the processing solution pH. A smaller value indicates a better result.

③ Preservability of latent image; sets of three strips each of Coating Samples 1 to 4 were prepared. Each sample was subjected to exposure with an optical wedge for 1/100 sec. One strip of each sample set was stored for 3 days at 50° C., 30%RH, while the another set member was stored for 3 days at 50° C., 80%RH. Further, remaining another set member was stored in a freezer, to serve as a control. Each sample was subjected to processing and sensitometry in the same manner as in ①, to determine the sensitivity of the sample. The results thus obtained were compared.

Processing Solution

| | |
|---|---|
| 1-Phenyl-3-pyrazolydone | 0.5 g |
| Hydroquinone | 10 g |
| Disodium ethylenediaminetetraacetate | 2 g |
| Potassium sulfite | 60 g |
| Boric acid | 4 g |
| Potassium carbonate | 20 g |
| Sodium bromide | 5 g |
| Diethylene glycol, | 20 g |
| Water to make | 1 liter |
| pH was adjusted by using sodium hydroxide to pH 10.0 | |

The thus obtained results (results of property evaluation) with characteristics of each coated sample are shown in Table 1 below.

process with the temperature maintained at 30° C. After the addition, the mixture was heated to 75° C. Then, 90 ml of 1.0 M silver nitrate solution was gradually added thereto, followed by addition of $NH_4OH$, and the reaction mixture was kept at pH 9.0 for 20 minutes. After that, the pH was lowered to the original level, and then a silver nitrate solution containing 150 g of silver nitrate was added thereto, with an accelerated feeding rate (the final feeding rate was 19 times the initial feeding rate), over a period of 60 minutes. During this procedure, KBr solution was added while maintaining pBr=2.05.

Further, 880 mppm of $K_4Ru(CN)_6$ was added thereto at the time when 70% of the total Ag amount was added.

After that, the resulting emulsion was cooled down to 35° C. and washed with water according to a conventional flocculation, and a gelatin solution was added thereto, to redisperse the emulsion. The emulsion was adjusted to a pH of 6.5 and a pAg of 8.6 at 40° C.

TABLE 1

| Coated Sample No. | Used emulsion | Crystal habit of tubular grains | Existence of epitaxy | $KRu(CN)_6$ addition: Addition | $KRu(CN)_6$ addition: Position | Sensitivity* | Suppression of dependency on a processing solution pH (%) | Preservability of latent image: 50° C., 30% RH* | Preservability of latent image: 50° C., 80% RH | Remarks |
|---|---|---|---|---|---|---|---|---|---|---|
| 1 | Emulsion-1 | {111} | None | Not added | — | 100 | 30 | 70 | 60 | Comparative example |
| 2 | Emulsion-2 | {100} | None | Not added | — | 120 | 25 | 70 | 65 | Comparative example |
| 3 | Emulsion-3 | {111} | Present | Not added | — | 125 | 30 | 70 | 60 | Comparative example |
| 4 | Emulsion-4 | {100} | Present | Not added | — | 150 | 28 | 80 | 75 | This invention |
| 5 | Emulsion-5 | {111} | None | Added | 70% | 115 | 30 | 70 | 65 | Comparative example |
| 6 | Emulsion-6 | {100} | None | Added | 70% | 125 | 15 | 70 | 70 | This invention |
| 7 | Emulsion-7 | {111} | Present | Added | Host (70%) | 130 | 28 | 70 | 65 | Comparative example |
| 8 | Emulsion-8 | {111} | Present | Added | Epitaxial part | 135 | 28 | 70 | 60 | Comparative example |
| 9 | Emulsion-9 | {100} | Present | Added | Host (70%) | 160 | 15 | 85 | 80 | This invention |
| 10 | Emulsion-10 | {100} | Present | Added | Epitaxial part | 165 | 12 | 85 | 85 | This invention |

Note: *Sensitivity was represented in a relative value, assuming that of Sample-1 in processing ① to be 100.

From Table 1, it is apparent that the present invention exhibits excellent effects. That is, of Samples 1 to 4, Sample 4 of the present invention provided the highest sensitivity, and surprisingly, it was also excellent in preservability of latent image. Further, of Samples 1, 2, 5 and 6, Sample 6 of the present invention provided the highest sensitivity, and surprisingly it was also excellent in suppression of dependency on the processing solution pH. Further, of all the samples, Samples 9 and 10 of the present invention provided the highest sensitivity, and they were also excellent in preservability of latent image and suppression of dependency on the processing solution pH.

Example 2

(1) Preparation of Emulsion

Preparation of Emulsion-11

To 1.4 liters of a 1.0 wt % gelatin solution containing 0.08 M potassium bromide, 0.5 M silver nitrate solution and 0.5 M potassium bromide solution were added, with stirring of each at a rate of 60 ml/30 sec according to a double jet A part of the obtained emulsion was sampled, and a TEM image [a transmission-type electron microscope photographic image] of the replica of the emulsion grains was observed. Observation of the TEM image revealed that 95% of the total projected area of the AgX grains (hereinafter abbreviated as TPA) comprised tabular grains having a {100} face as a main plane and having an aspect ratio of 3 or more. The tabular grains had an average diameter of 0.55 μm, an average aspect ratio of 4.0, and a coefficient of variation of diameter distribution (standard deviation of distribution/mean diameter) (hereinafter abbreviated as C.V.) of 0.21.

Then, a 0.5 mol sample of the thus-obtained emulsion was melted at 40° C., and its pBr was adjusted to ca. 4 with a simultaneous addition of $AgNO_3$ and KI solutions in such a ratio that the small amount of silver halide precipitated during this adjustment was 12% I. Then, 2 M % NaCl (based on the original amount of host grains) was added, followed by addition of a spectral sensitizing dye, after which 6 M % silver iodobromochloride epitaxy was formed by the addition order set forth below, to obtain Emulsion-11. 2.52 M % $Cl^-$ added as $CaCl_2$, 2.52 M % $Br^-$ added as NaBr, 0.96 M % $I^-$ added as a suspension of AgI (Lippmann), and 5.04 M % $AgNO_3$.

The sensitizing dye that was used in this preparation, was S-10.

Preparation of Emulsion-12

Emulsion-12 was prepared in the same manner as Emulsion-11, except for adding $K_4Ru(CN)_6$ after the addition of NaBr but prior to addition of $AgNO_3$ during the introduction period of silver iodobromochloride epitaxy, in place of adding $K_4Ru(CN)_6$ into host grains.

Preparation of Emulsion-13

In a reaction vessel was put an aqueous gelatin solution-7 (containing 25 g of gelatin and 0.3 g of KBr in 1.2 liters of $H_2O$, adjusted to pH 6.0). Then, with the temperature kept at 32° C., Ag-41 solution and X-41 solution were simultaneously added thereto, with stirring of both, at a rate of 30 ml/min, over 5 minutes. Then, an aqueous solution containing 10 g of polyvinylimidazole copolymer 2 [represented by formula (5), whose weight average molecular weight was $1.5\times10^5$ and x:y:z:w=60:7:13:30], and 100 ml of $H_2O$, was added thereto, and the obtained emulsion was adjusted to pH 9.0 with 1N-NaOH solution. Then, the emulsion was heated to 60° C. and adjusted again to pH 9.0 and a silver potential of 25 mV using a KBr solution (containing 0.1 g of KBr/ml). After that, Ag-41 solution and X-41 solution were simultaneously added thereto over 20 minutes, with the silver potential maintained at 25 mV. The feeding rate of Ag-41 solution was 25 ml/min. Further, 880 mppm of $K_4Ru(CN)_6$ was added thereto at the time when 70% of the total Ag amount was added. After stirring for 3 minutes after the addition, a precipitant was added, the temperature was lowered to 30° C., and the pH was adjusted to 4.0, to precipitate the emulsion. The precipitated emulsion was washed with water, again heated to 38° C., and re-dispersed in an aqueous solution of gelatin. The emulsion was adjusted to a pBr of 2.8 and a pH of 6.4.

Polyvinylimidazole Copolymer 2

(5)

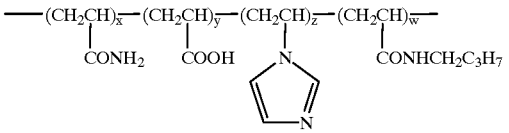

The TEM image of the replica of the thus-obtained emulsion grains was prepared. Observation of the TEM image revealed that 95% of TPA was occupied by tabular grains having a {100} face as a main plane, a right-angled parallelogram as a projected contour, an average diameter of 0.55 μm, an average aspect ratio of 4.0, and an average slenderness ratio (long side/short side ratio) of 1.8.

Then, silver iodobromochloride epitaxy was formed in the same manner as in Emulsion-11, to obtain Emulsion-13.

Preparation of Emulsion-14

Emulsion-14 was prepared in the same manner as Emulsion-13, except for adding $K_4Ru(CN)_6$ after the addition of NaBr but prior to the addition of $AgNO_3$ during the introduction period of silver iodobromochloride epitaxy, in place of adding $K_4Ru(CN)_6$ into host grains.

Chemical Sensitization

To each of Emulsion-11 to -14, were added a sensitizing dye (when silver halide epitaxy existed, an amount, from which the amount of the sensitizing dye to be used during the introduction period of the epitaxy was deducted, was employed), KSCN, hypo, chloroauric acid, and AMPT, in the optimum amounts, and the resulting mixture was heated at 55° C. for the optimum period of time. After cooling down to 40° C., AMPT was added thereto.

Evaluation of Emulsion-11 to -14

Coated samples were prepared in the same manner as in Example-1 (2) by using each of Emulsion-11 to -14 obtained above, and they were subjected to the same evaluation tests. As a result of evaluation of photographic properties, it was found that these samples also exhibited almost the same results as those utilizing Emulsion-7 to -10.

Further, multi-layer color photographic light-sensitive materials were prepared as illustrated below.

Preparation of Sample 201

Layers having the below-shown compositions were formed on a cellulose triacetate film support, having a thickness of 127 μm, that had been provided an undercoat, to prepare a multi-layer color light-sensitive material, which was named Sample 201. Each figure represents the added amount per square meter. In passing, it should be noted that the effect of the added compounds is not limited to the described use.

First Layer (Halation-preventing Layer)

| | |
|---|---|
| Black colloidal silver | 0.10 g |
| Gelatin | 1.90 g |
| Ultraviolet ray absorbent U-1 | 0.10 g |
| Ultraviolet ray absorbent U-3 | 0.040 g |
| Ultraviolet ray absorbent U-4 | 0.10 g |
| High-boiling organic solvent Oil-1 | 0.10 g |
| Fine crystal solid dispersion of Dye E-1 | 0.10 g |

Second Layer (Intermediate Layer)

| | |
|---|---|
| Gelatin | 0.40 g |
| Compound Cpd-C | 5.0 mg |
| Compound Cpd-J | 5.0 mg |
| Compound Cpd-K | 3.0 mg |
| High-boiling organic solvent Oil-3 | 0.10 g |
| Dye D-4 | 0.80 mg |

Third Layer (Intermediate Layer)

| | | |
|---|---|---|
| Silver iodobromide emulsion of fine grains, surface and inner part of which were fogged (av. grain diameter: 0.06 μm, deviation coefficient: 18%, AgI content: 1 mol %) | silver | 0.050 g |
| Yellow colloidal silver | silver | 0.030 g |
| Gelatin | | 0.40 g |

Fourth Layer (Low Sensitivity Red-sensitive Emulsion Layer)

| | | |
|---|---|---|
| Emulsion A | silver | 0.30 g |
| Emulsion B | silver | 0.20 g |
| Gelatin | | 0.80 g |
| Coupler C-1 | | 0.15 g |
| Coupler C-2 | | 0.050 g |
| Coupler C-3 | | 0.050 g |
| Coupler C-9 | | 0.050 g |
| Compound Cpd-C | | 5.0 mg |
| Compound Cpd-J | | 5.0 mg |

-continued

| | | |
|---|---|---|
| High-boiling organic solvent Oil-2 | | 0.10 g |
| Additive P-1 | | 0.10 g |

Fifth Layer (Medium Sensitivity Red-sensitive Emulsion Layer)

| | | |
|---|---|---|
| Emulsion C | silver | 0.50 g |
| Gelatin | | 0.80 g |
| Coupler C-1 | | 0.20 g |
| Coupler C-2 | | 0.050 g |
| Coupler C-3 | | 0.20 g |
| High-boiling organic solvent Oil-2 | | 0.10 g |
| Additive P-1 | | 0.10 g |

Sixth Layer (High Sensitivity Red-sensitive Emulsion Layer)

| | | |
|---|---|---|
| Emulsion D | silver | 0.40 g |
| Gelatin | | 1.10 g |
| Coupler C-1 | | 0.30 g |
| Coupler C-2 | | 0.10 g |
| Coupler C-3 | | 0.70 g |
| Additive P-1 | | 0.10 g |

Seventh Layer (Intermediate Layer)

| | | |
|---|---|---|
| Gelatin | | 0.60 g |
| Additive M-1 | | 0.30 g |
| Color-mix preventing agent Cpd-I | | 2.6 mg |
| Dye D-5 | | 0.020 g |
| Dye D-6 | | 0.010 g |
| Compound Cpd-J | | 5.6 mg |
| High-boiling organic solvent Oil-1 | | 0.020 g |

Eighth Layer (Intermediate Layer)

| | | |
|---|---|---|
| Silver iodobromide emulsion, surface and inner part of which were fogged (av. grain diameter: 0.06 μm, deviation coefficient: 16%, AgI content: 0.3 mol %) | silver | 0.020 g |
| Yellow colloidal silver | silver | 0.020 g |
| Gelatin | | 1.00 g |
| Additive P-1 | | 0.20 g |
| Color-mix preventing agent Cpd-A | | 0.10 mg |
| Compound Cpd-C | | 0.10 g |

Ninth Layer (Low Sensitivity Green-sensitive Emulsion Layer)

| | | |
|---|---|---|
| Emulsion 11 | silver | 0.50 g |
| Gelatin | | 0.50 g |
| Coupler C-4 | | 0.10 g |
| Coupler C-7 | | 0.050 g |
| Coupler C-8 | | 0.10 g |
| Compound Cpd-B | | 0.030 g |
| Compound Cpd-D | | 0.020 g |
| Compound Cpd-E | | 0.020 g |
| Compound Cpd-F | | 0.040 g |
| Compound Cpd-J | | 10 mg |
| Compound Cpd-L | | 0.020 g |

-continued

| | | |
|---|---|---|
| High-boiling organic solvent Oil-1 | | 0.10 g |
| High-boiling organic solvent Oil-2 | | 0.10 g |

Tenth Layer (Medium Sensitivity Green-sensitive Emulsion Layer)

| | | |
|---|---|---|
| Emulsion F | silver | 0.40 g |
| Gelatin | | 0.60 g |
| Coupler C-4 | | 0.070 g |
| Coupler C-7 | | 0.050 g |
| Coupler C-8 | | 0.050 g |
| Compound Cpd-B | | 0.030 g |
| Compound Cpd-D | | 0.020 g |
| Compound Cpd-E | | 0.020 g |
| Compound Cpd-F | | 0.050 g |
| Compound Cpd-L | | 0.050 g |
| High-boiling organic solvent Oil-2 | | 0.010 g |
| High-boiling organic solvent Oil-4 | | 0.050 g |

Eleventh Layer (High Sensitivity Green-sensitive Emulsion Layer)

| | | |
|---|---|---|
| Emulsion G | silver | 0.50 g |
| Gelatin | | 1.00 g |
| Coupler C-4 | | 0.20 g |
| Coupler C-7 | | 0.10 g |
| Coupler C-8 | | 0.050 g |
| Compound Cpd-B | | 0.080 g |
| Compound Cpd-E | | 0.020 g |
| Compound Cpd-F | | 0.040 g |
| Compound Cpd-K | | 5.0 mg |
| Compound Cpd-L | | 0.020 g |
| High-boiling organic solvent Oil-1 | | 0.020 g |
| High-boiling organic solvent Oil-2 | | 0.020 g |

Twelfth Layer (Intermediate Layer)

| | | |
|---|---|---|
| Gelatin | | 0.60 g |
| Compound Cpd-L | | 0.050 g |
| High-boiling organic solvent Oil-1 | | 0.050 g |

Thirteenth Layer (Yellow Filter Layer)

| | | |
|---|---|---|
| Yellow colloidal silver | silver | 0.020 g |
| Gelatin | | 1.10 g |
| Color-mix preventing agent Cpd-A | | 0.010 g |
| Compound Cpd-L | | 0.010 g |
| High-boiling organic solvent Oil-1 | | 0.010 g |
| Fine crystal solid dispersion of Dye E-2 | | 0.030 g |
| Fine crystal solid dispersion of Dye E-3 | | 0.020 g |

Fourteenth Layer (Intermediate Layer)

| | | |
|---|---|---|
| Gelatin | | 0.60 g |

Fifteenth Layer (Low Sensitivity Blue-sensitive Emulsion Layer)

| | | |
|---|---|---|
| Emulsion H | silver | 0.20 g |
| Emulsion I | silver | 0.30 g |
| Gelatin | | 0.80 g |
| Coupler C-5 | | 0.20 g |
| Coupler C-6 | | 0.10 g |
| Coupler C-10 | | 0.40 g |

Sixteenth Layer (Medium Sensitivity Blue-sensitive Emulsion Layer)

| | | |
|---|---|---|
| Emulsion J | silver | 0.50 g |
| Gelatin | | 0.90 g |
| Coupler C-5 | | 0.10 g |
| Coupler C-6 | | 0.10 g |
| Coupler C-10 | | 0.60 g |

Seventeenth Layer (High Sensitivity Blue-sensitive Emulsion Layer)

| | | |
|---|---|---|
| Emulsion K | silver | 0.40 g |
| Gelatin | | 1.20 g |
| Coupler C-5 | | 0.10 g |
| Coupler C-6 | | 0.10 g |
| Coupler C-10 | | 0.60 g |

Eighteenth Layer (First Protective Layer)

| | |
|---|---|
| Gelatin | 0.70 g |
| Ultraviolet ray absorber U-1 | 0.20 g |
| Ultraviolet ray absorber U-2 | 0.050 g |
| Ultraviolet ray absorber U-5 | 0.30 g |
| Compound Cpd-G | 0.050 g |
| Formalin scavenger Cpd-H | 0.40 g |
| Dye D-1 | 0.15 g |
| Dye D-2 | 0.050 g |
| Dye D-3 | 0.10 g |
| High-boiling organic solvent Oil-3 | 0.10 g |

Nineteenth Layer (Second Protective Layer)

| | |
|---|---|
| Yellow colloidal silver | silver 0.10 mg |
| Silver iodobromide emulsion of fine grains (av. grain diameter: 0.06 μm, AgI content: 1 mol %) | silver 0.10 g |
| Gelatin | 0.40 g |

Twentieth Layer (Third Protective Layer)

| | |
|---|---|
| Gelatin | 0.40 g |
| Poly(methyl methacrylate) (average grain diameter 1.5 μm) | 0.10 g |
| Copolymer of methyl methacrylate and acrylic acid (4:6) (average grain diameter 1.5 μm) | 0.10 g |
| Silicon oil So-1 | 0.030 g |
| Surface active agent W-1 | 3.0 mg |
| Surface active agent W-2 | 0.030 g |

Further, to all emulsion layers, in addition to the above-described components, additives F-1 to F-8 were added. Further, to each layer, in addition to the above-described components, a gelatin hardener H-1 and surface active agents W-3, W-4, W-5, and W-6 for coating and emulsifying, were added.

Further, as antifungal and antibacterial agents, phenol, 1,2-benzisothiazoline-3-one, 2-phenoxyethanol, phenetylalcohol, and p-benzoic acid butyl ester were added.

Preparation of a Dispersion of Organic Solid Dispersed Dye

Dye E-1 was dispersed in accordance with the following method. To 1430 g of a wet cake of dye containing 30% methanol, water and 200 g of Pluronic F88, trade name, manufactured by BASF Co. (ethylene oxide/propylene oxide block copolymer), were added, with stirring, to prepare a slurry containing 6% dye. Then, 1700 ml of zirconia beads having an average diameter of 0.5 mm was filled into ULTRAVISCOMILL (UVM-2), manufactured by IMEX Co., Ltd., through which the above-obtained slurry was passed and ground at the round speed of about 10 m/sec and a discharge rate of 0.5 liters/min for 8 hrs. After the beads were removed from the slurry by filtration, the filtrate was added to water, in order to dilute the dye density to 3%, followed by heating at 90° C. for 10 hrs, for stabilization. The thus-obtained fine particles had an average diameter of 0.60 μm and a range of diameter distribution (standard deviation of grain diameter×100/average diameter) of 18%.

Likewise, solid dispersions of Dye E-2 or E-3 were obtained, respectively. These dye fine particles had average diameters of 0.54 μm and 0.56 μm, respectively.

Silver halide emulsions that were used in Sample 201, and dyes that were used in these emulsions, are illustrated in Tables 2 and 3.

TABLE 2

| Emulsion | Feature of grain | Average grain-diameter corresponding to sphere (μm) | Coefficient of variation of grain size distribution (%) | AgI content (%) | AgI content on grain surface (%) | Coefficient of variation of AgI content distribution among grains (%) | (111)/(100) plane ratio |
|---|---|---|---|---|---|---|---|
| A | Tabular grain, average aspect ratio of 5.0 | 0.40 | 25 | 3.5 | 3.5 | 60 | 97/3 |
| B | Tabular internal latent | 0.50 | 25 | 3.5 | 3.0 | 30 | 99/1 |

TABLE 2-continued

| Emulsion | Feature of grain | Average grain-diameter corresponding to sphere (μm) | Coefficient of variation of grain size distribution (%) | AgI content (%) | AgI content on grain surface (%) | Coefficient of variation of AgI content distribution among grains (%) | (111)/(100) plane ratio |
|---|---|---|---|---|---|---|---|
| | image-type grain, average aspect ratio of 5.0 | | | | | | |
| C | Tabular grain, average aspect ratio of 8.0 | 0.62 | 25 | 3.0 | 1.5 | 20 | 99/1 |
| D | Tabular grain, average aspect ratio of 8.0 | 1.04 | 10 | 1.6 | 1.0 | 8 | 99/1 |
| 11 | Tabular grain, average aspect ratio of 4.0 | 0.40 | 21 | 1.2 | 3.0 | 20 | 98/2 |
| F | Tabular grain, average aspect ratio of 8.0 | 0.66 | 15 | 3.2 | 2.5 | 10 | 99/1 |
| G | Tabular grain, average aspect ratio of 10 | 1.20 | 8 | 2.8 | 2.0 | 10 | 99/1 |
| H | Tabular grain, average aspect ratio of 5.0 | 0.42 | 20 | 4.6 | 3.0 | 35 | 97/3 |
| I | Tabular grain, average aspect ratio of 8.0 | 0.71 | 15 | 4.6 | 2.3 | 30 | 98/2 |
| J | Tabular grain, average aspect ratio of 8.0 | 0.71 | 8 | 2.0 | 1.3 | 20 | 99/1 |
| K | Tabular grain, average aspect ratio of 10 | 1.30 | 8 | 1.0 | 1.0 | 15 | 99/1 |

TABLE 3

| Spectral sensitization of emulsions | | | |
|---|---|---|---|
| Emulsion | Sensitizing dye added | Added amount (g) per mol of silver halide | Timing of addition of sensitizing dye |
| A | S-3 | 0.025 | During grain formation |
| | S-2 | 0.40 | |
| | S-1 | 0.01 | |
| B | S-3 | 0.01 | During grain formation |
| | S-2 | 0.40 | |
| C | S-3 | 0.01 | Before chemical sensitization |
| | S-2 | 0.30 | |
| | S-1 | 0.10 | |
| D | S-3 | 0.01 | |
| | S-2 | 0.15 | Before chemical sensitization |
| | S-1 | 0.10 | |
| | S-8 | 0.01 | |
| 11 | S-4 | 0.5 | Before chemical sensitization (a part was before epitaxy) |
| F | S-4 | 0.40 | Immediately after grain formation |
| | S-9 | 0.1 | |
| G | S-4 | 9.30 | Before chemical sensitization |
| | S-5 | 0.08 | |
| | S-9 | 0.05 | |

TABLE 3-continued

| Spectral sensitization of emulsions | | | |
|---|---|---|---|
| Emulsion | Sensitizing dye added | Added amount (g) per mol of silver halide | Timing of addition of sensitizing dye |
| H | S-4 | 0.25 | Before chemical sensitization |
| | S-5 | 0.06 | |
| | S-9 | 0.05 | |
| I | S-6 | 0.07 | Immediately after grain formation |
| | S-7 | 0.45 | |
| J | S-6 | 0.05 | Immediately after grain formation |
| | S-7 | 0.30 | |
| K | S-6 | 0.05 | Before chemical sensitization |
| | S-7 | 0.25 | |

C-1
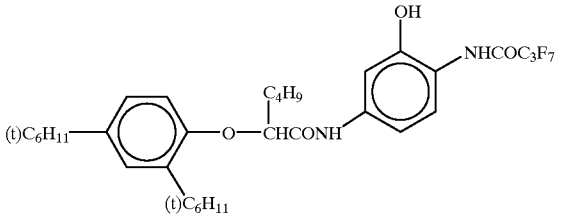
C-2
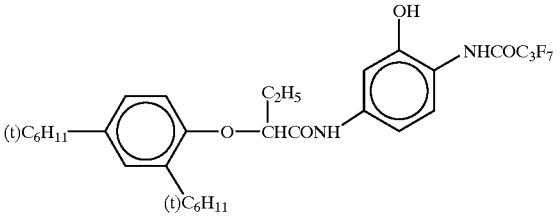
C-3
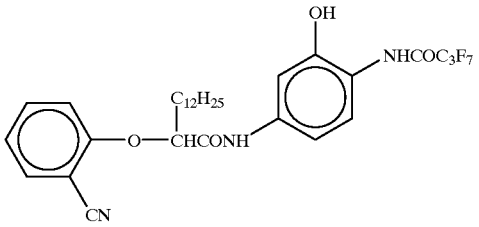
C-4
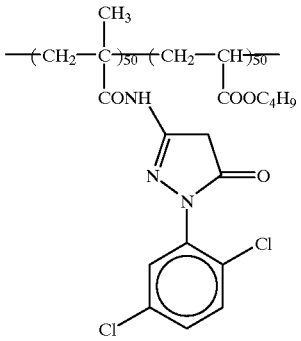
Figures indicate amounts
by % by weight
Average molecular weight:
ca. 25,000
C-5
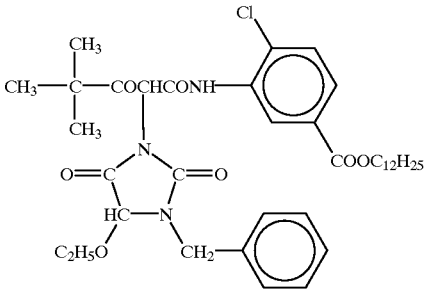
C-6
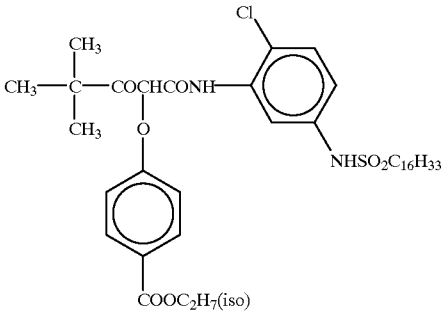
C-7
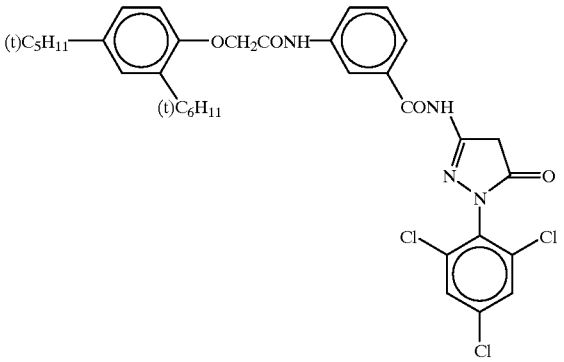
C-8
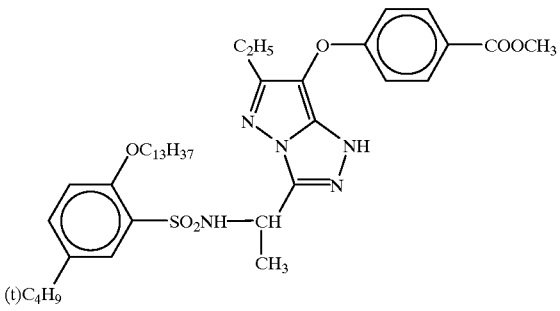

-continued
C-9
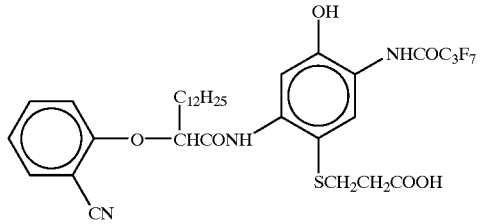
C-10
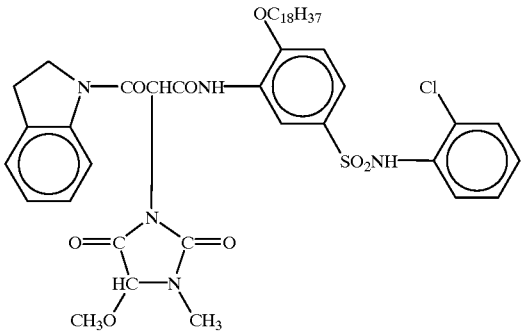
Oil-1
Dibutyl phthalate
Oil-2
Tricresyl phosphate
Oil-3
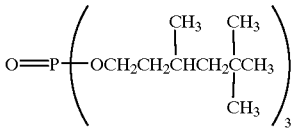
Oil-4
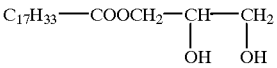
Cpd-A
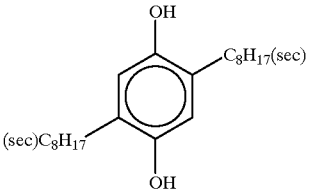
Cpd-B
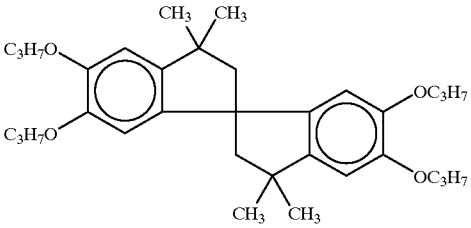
Cpd-C
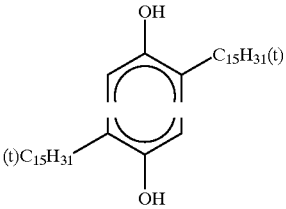
Cpd-D
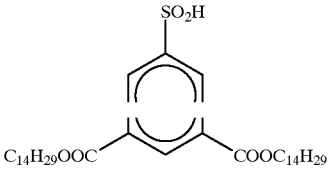
Cpd-E
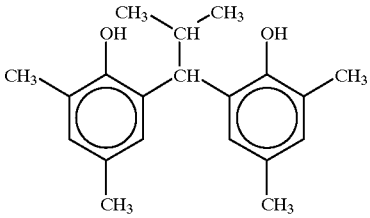
Cpd-F
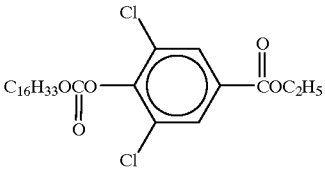
Cpd-G
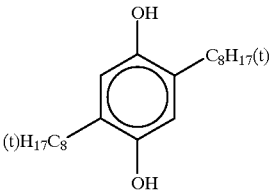
Cpd-H
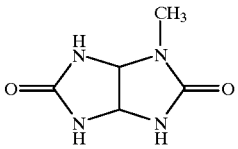

-continued
Cpd-I
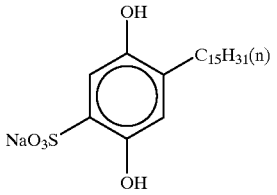
Cpd-J
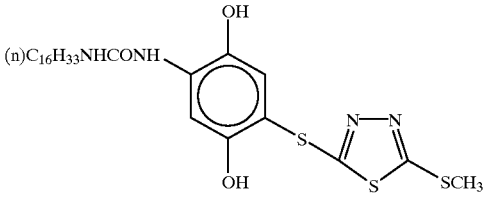
Cpd-K
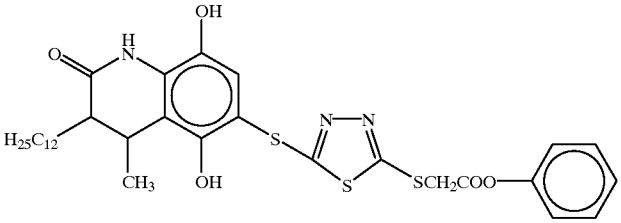
Cpd-L
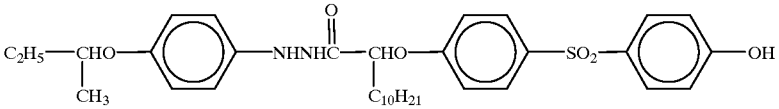
U-1
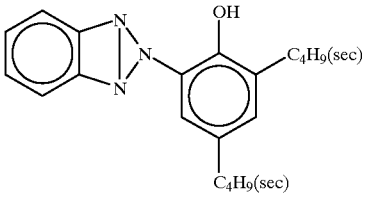
U-2
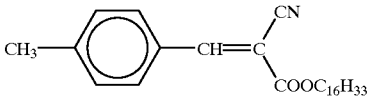
U-3
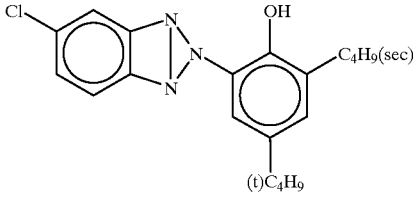
U-4
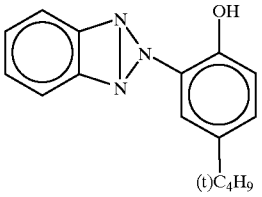
U-5
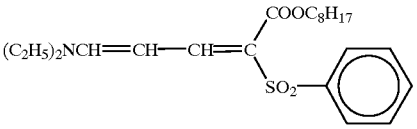
S-1
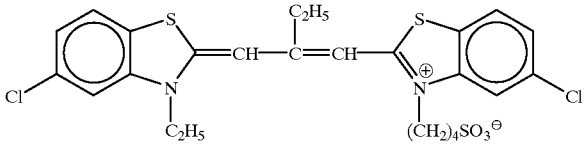
S-2
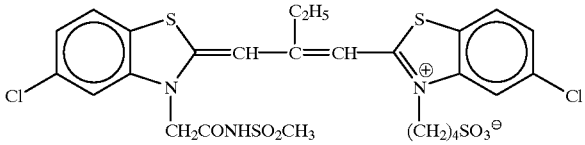

-continued
S-3
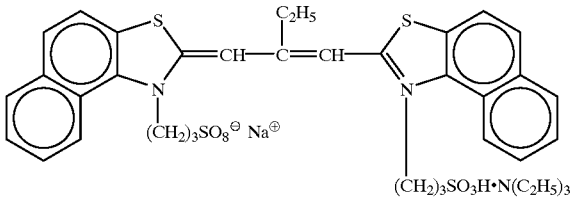
S-4
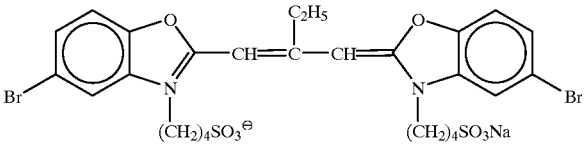
S-5
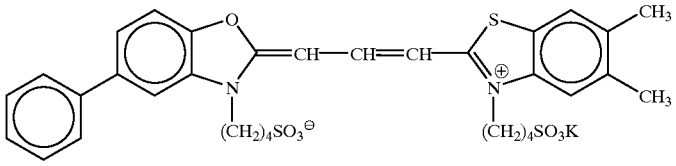
S-6
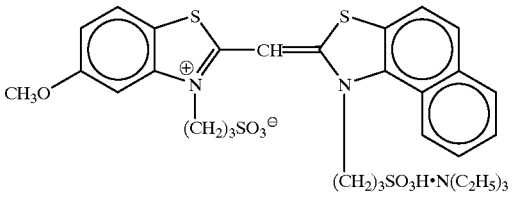
S-7
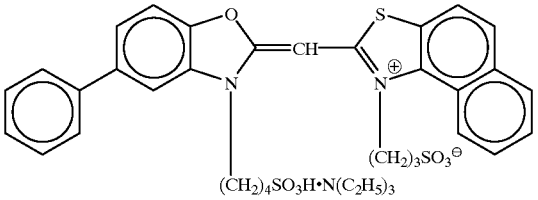
S-8
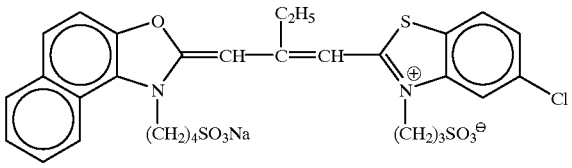
S-9
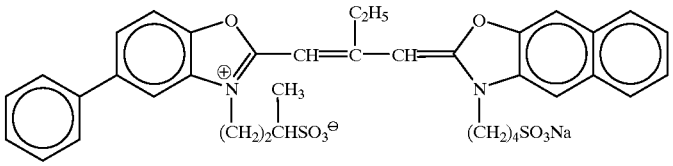
d-1
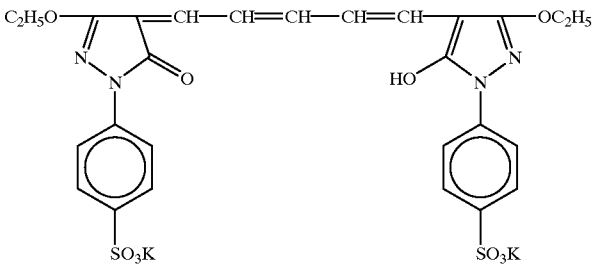

-continued
d-2
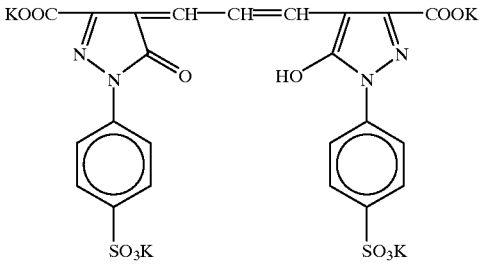
d-3
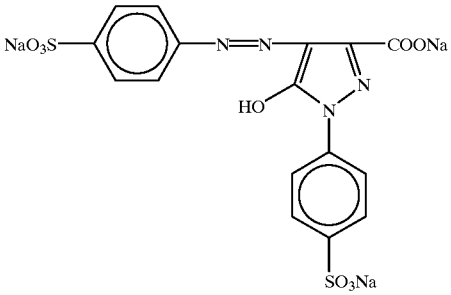
D-4
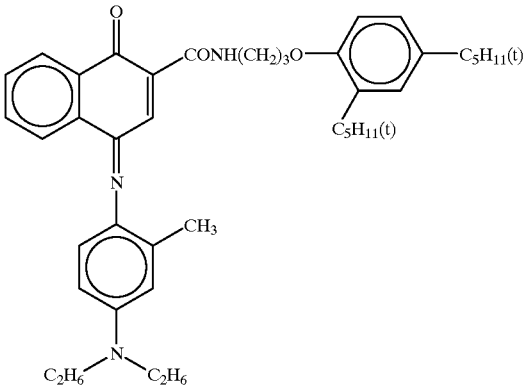
D-5
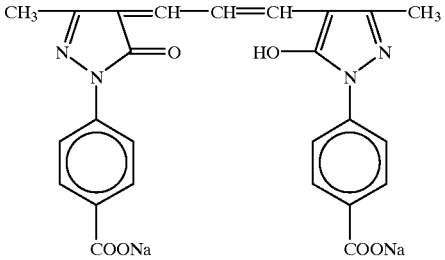
D-6
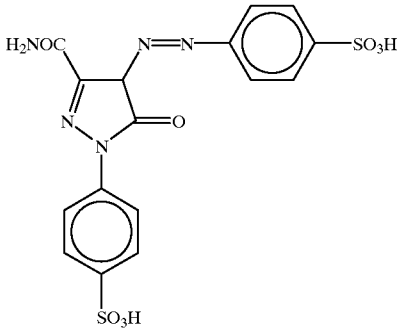
E-1
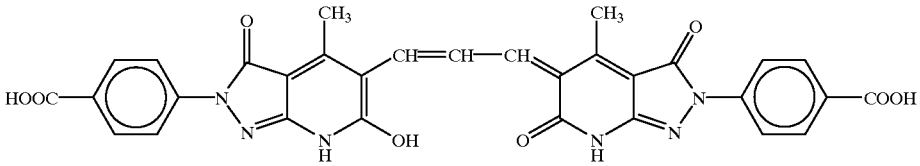
E-2
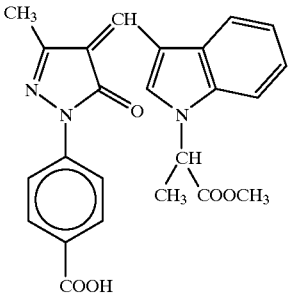
E-3
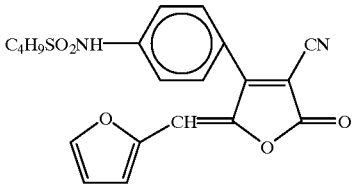

-continued
H-1
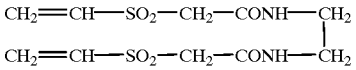
W-1
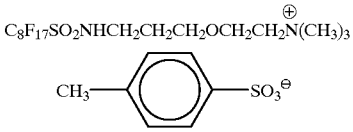
W-2
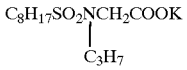
W-3
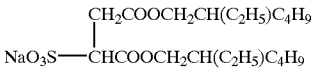
W-4
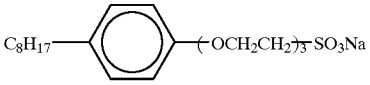
W-5
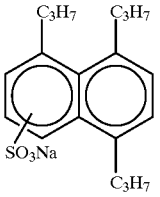
W-6
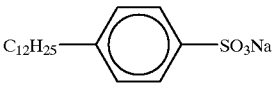
P-1
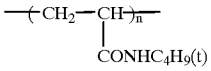
M-1
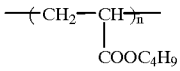
F-1
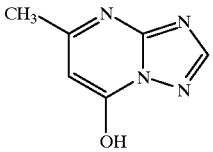
So-1
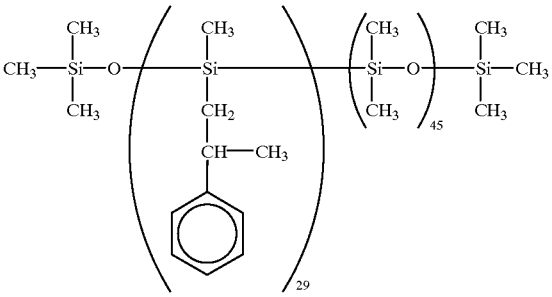
F-2
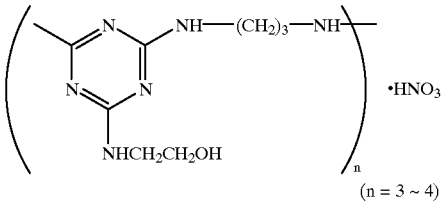
(n = 3 ~ 4)
F-3
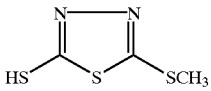
F-4
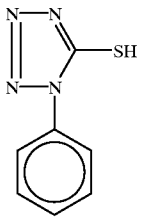
F-5
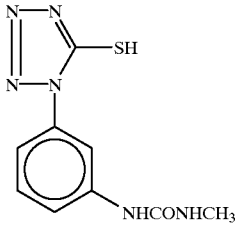
F-6
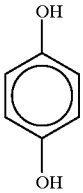

-continued

F-7

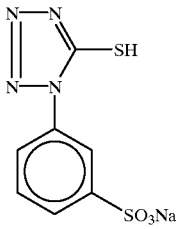

F-8

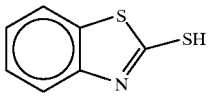

Preparation of Samples 202 to 204

Samples 202 to 204 were prepared in the same manner as Sample 201, except for each respectively using Emulsion-12 to -14 in place of Emulsion-11 that was employed in the low sensitivity green-sensitive emulsion layer of the ninth layer.

(Evaluation of Samples)

These samples were exposed to light for $10^{-2}$ seconds through an optical wedge by means of a white light source, followed by development processing as illustrated below. Evaluation of fresh photographic properties was conducted by sensitometry. The terminology "fresh" as referred to above denoted the samples prior to a preservation test.

The sensitivity of the ninth layer of Samples 201 to 204 was estimated by a reciprocal of an exposure amount required to produce a density that was 0.5 bigger the minimum magenta density.

Further, suppression of dependency on the processing solution pH was evaluated by changing the pH of the first development. Furthermore, evaluation of preservability of a latent image was conducted using the same condition as in Example 1. Moreover, evaluation of granularity was conducted by means of a microscope, with respect to strips that were prepared by processing these samples.

The processing steps and processing solutions for development processing in the standard processing are shown below.

| Processing step | Time | Temperature | Tank volume | Replenisher amount |
|---|---|---|---|---|
| 1st development | 6 min | 38° C. | 12 liter | 2,200 ml/m$^2$ |
| 1st water-washing | 2 min | 38° C. | 4 liter | 7,500 ml/m$^2$ |
| Reversal | 2 min | 38° C. | 4 liter | 1,100 ml/m$^2$ |
| Color development | 6 min | 38° C. | 12 liter | 2,200 ml/m$^2$ |
| Pre-bleaching | 2 min | 38° C. | 4 liter | 1,100 ml/m$^2$ |
| Bleaching | 6 min | 38° C. | 12 liter | 220 ml/m$^2$ |
| Fixing | 4 min | 38° C. | 8 liter | 1,100 ml/m$^2$ |
| 2nd water-washing | 4 min | 38° C. | 8 liter | 7,500 ml/m$^2$ |
| Final-rinsing | 1 min | 25° C. | 2 liter | 1,100 ml/m$^2$ |

Compositions of each processing solution used were as follows:

| First developer | Tank solution | Replenisher |
|---|---|---|
| Pentasodium nitrilo-N,N,N-trimethylenephosphonate | 1.5 g | 1.5 g |
| Pentasodium diethylenetriamine-pentaacetate | 2.0 g | 2.0 g |
| Sodium sulfite | 30 g | 30 g |
| Hydroquinone/potassium monosulfonate | 20 g | 20 g |

-continued

| First developer | Tank solution | Replenisher |
|---|---|---|
| Potassium carbonate | 15 g | 20 g |
| Sodium bicarbonate | 12 g | 15 g |
| 1-Phenyl-4-methyl-4-hydroxymethyl-3-pyrazolydone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethylene glycol | 13 g | 15 g |
| Water to make | 1,000 ml | 1,000 ml |
| pH | 9.60 | 9.60 |
| (pH was adjusted by using sulfuric acid or potassium hydroxide) | | |

| Reversal solution | |
|---|---|
| (Both tank solution and replenisher) | 3.0 g |
| Pentasodium nitrilo-N,N,N-trimethylenephosphonate | |
| Stannous chloride dihydrate | 1.0 g |
| p-Aminophenol | 0.1 g |
| Sodium hydroxide | 8 g |
| Glacial acetic adid | 15 ml |
| Water to make | 1,000 ml |
| pH | 6.00 |
| (pH was adjusted by using acetic acid or sodium hydroxide) | |

| Color developer | Tank solution | Replenisher |
|---|---|---|
| Pentasodium nitrilo-N,N,N-trimethylenephosphonate | 2.0 g | 2.0 g |
| Sodium sulfite | 7.0 g | 7.0 g |
| Trisodium phosphate 12-hydrate | 36 g | 36 g |
| Potassium brornide | 1.0 g | — |
| Potassium iodide | 90 mg | — |
| Sodium hydroxide | 3.0 g | 3.0 g |
| Cytrazinic acid | 1.5 g | 1.5 g |
| N-Ethyl-N-(β-methanesulfonamidoethyl)-3-methyl-4-aminoaniline 3/2 sulfate mono hydrate | 11 g | 11 g |
| 3,6-Dithiaoctane-1,8-diol | 1.0 g | 1.0 g |
| Water to make | 1,000 ml | 1,000 ml |
| pH | 11.80 | 12.00 |
| (pH was adjusted by using sulfuric acid or potassium hydroxide) | | |

| Pre-bleaching solution | Tank Solution | Reple-isher |
|---|---|---|
| Disodium ethylenediaminetetraacetate dihydrate | 8.0 g | 8.0 g |
| Sodium sulfite | 6.0 g | 8.0 g |
| 1-Thioglycerol | 0.4 g | 0.4 g |
| Formaldehyde · sodium bisulfite adduct | 30 g | 35 g |
| Water to make | 1,000 ml | 1,000 ml |
| pH | 6.30 | 6.10 |
| (pH was adjusted by using acetic acid or sodium hydroxide) | | |

| Bleaching solution | Tank solution | Reple-nisher |
|---|---|---|
| Disodium ethylenediaminetetraacetate dihydrate | 2.0 g | 4.0 g |
| Iron (III) ammonium ethylenediamine- | 120 g | 240 g |
| tetraacetate dihydrate | 120 g | 240 g |
| Potassium bromide | 100 g | 200 g |
| Ammonium nitrate | 10 g | 20 g |
| Water to make | 1,000 ml | 1.000 ml |
| pH | 5.70 | 5.50 |
| (pH was adjusted by using nitric acid or sodium hydroxide) | | |

| Fixing solution (Both tank solution, and replenisher) | |
|---|---|
| Ammonium thiosulfate | 80 g |
| Sodium sulfite | 5.0 g |
| Sodium bisulfite | 5.0 g |
| Water to make | 1,000 ml |
| pH | 6.60 |
| (pH was adjusted by using acetic acid or aqueous ammonia) | |

| Stabilizing solution | Tank solution | Reple-nisher |
|---|---|---|
| 1,2-Benzoisothiazolin-3-one | 0.02 g | 0.03 g |
| Polyoxyethylene-p-monononyl phenyl ether (av. polymerization degree: 10) | 0.3 g | 0.3 g |
| Polymaleic acid (av. molecular weight 2,000) | 0.1 g | 0.15 g |
| Water to make | 1,000 ml | 1,000 ml |
| pH | 7.0 | 7.0 |

As a result, it was recognized that the same effect as the evaluation of the preceding Emulsion-11 to -14 was attained. Further, it was also recognized that Samples 203 and 204 were remarkably improved in granularity than Samples 201 and 202.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide emulsion that comprises at least a dispersion medium and silver halide grains, wherein 60% or more of the total projected area of the said silver halide grains is occupied by tabular grains having an epitaxial junction, which grains each have a {100} face as a main plane and an aspect ratio (diameter/thickness ratio) of from 2.0 to 100; and wherein a right-angled parallelogram enclosed with {100} side faces at the main plane edges on the portion of the tabular grains, which portion does not have the epitaxial junction, or if the tabular grains have at least one corner broken off, a right-angled parallelogram formed by extending the {100} side faces at the main plane edges, has a slenderness side ratio (a ratio of the length of the long side to that of the short side) of 1 to 6; and wherein the tabular grains have the epitaxial junction with a silver halide protrusion that has a higher solubility than the portion of the tabular grains, which portion does not have the epitaxial junction; and wherein the silver halide grains have an AgCl content of 0 to 50 mol %.

2. The silver halide emulsion as claimed in claim 1, wherein the said tabular grains have crystal defects for anisotropic growth, and wherein a six-coordinate dopant capable of forming a shallow electron trap in the said tabular grains and/or the said silver halide protrusion, is present in a crystal lattice.

3. The silver halide emulsion as claimed in claim 1, wherein the silver halide emulsion is prepared in the presence of a compound $A^0$ and/or a compound $B^0$, wherein the compound $A^0$ represents an organic compound having covalently bonded to each individual molecule thereof at least two molecules of an adsorbent that accelerates formation of a {100} face of AgBr grains, wherein the compound $B^0$ represents an organic compound, except gelatins, having at least two alcoholic groups (hydroxyl groups) per molecule, and wherein both the compounds $A^0$ and $B^0$ are organic compounds, except gelatins and other proteins.

4. The silver halide emulsion as claimed in claim 2, wherein the said crystal defects are formed by addition of $Ag^+$ and halide ions with a compound $A^0$ and/or a compound $B^0$ being adsorbed on the silver halide grains, wherein the compound $A^0$ represents an organic compound having covalently bonded to each individual molecule thereof at least two molecules of an adsorbent that accelerates formation of a {100} face of AgBr grains, wherein the compound $B^0$ represents an organic compound, except gelatins, having at least two alcoholic groups (hydroxyl groups) per molecule, and wherein both the compounds $A^0$ and $B^0$ are organic compounds, except gelatins and other proteins.

5. The silver halide emulsion as claimed in claim 2, wherein the said crystal defects are formed by forming at least one halogen composition gap interface during nucleation, the halogen composition gap interface making a halogen composition difference of 10 mol % or more in a $Cl^-$, $Br^-$, or $I^-$ content.

6. A silver halide emulsion that comprises at least a dispersion medium and silver halide grains, wherein 60% or more of the total projected area of the said silver halide grains is occupied by tabular grains having crystal defects for anisotropic growth, which grains each have a {100} face as a main plane and an aspect ratio (diameter/thickness ratio) of not less than 2.0; and wherein a right-angled parallelogram enclosed with {100} side faces at the main plane edges of the tabular grains, or if the tabular grains have at least one corner broken off, a right-angled parallelogram formed by extending the {100} side faces at the main plane edges, has a slenderness side ratio (a ratio of the length of the long side to that of the short side) of 1 to 6; and wherein a six-coordinate dopant capable of forming a shallow electron trap is present in a crystal lattice; and wherein the silver halide grains have an AgCl content of 0 to 50 mol %.

7. The silver halide emulsion as claimed in claim 6, wherein the silver halide emulsion is prepared in the presence of a compound $A^0$ and/or a compound $B^0$, wherein the compound $A^0$ represents an organic compound having covalently bonded to each individual molecule thereof at least two molecules of an adsorbent that accelerates formation of a {100} face of AgBr grains, wherein the compound $B^0$ represents an organic compound, except gelatins, having at least two alcoholic groups (hydroxyl groups) per molecule, and wherein both the compounds $A^0$ and $B^0$ are organic compounds, except gelatins and other proteins.

8. The silver halide emulsion as claimed in claim 6, wherein the said crystal defects are formed by addition of $Ag^+$ and halide ions with a compound $A^0$ and/or a compound $B^0$ being adsorbed on the silver halide grains, wherein the compound $A^0$ represents an organic compound having covalently bonded to each individual molecule thereof at least two molecules of an adsorbent that accelerates formation of a {100} face of AgBr grains, wherein the compound $B^0$ represents an organic compound, except gelatins, having at least two alcoholic groups (hydroxyl groups) per molecule, and wherein both the compounds $A^0$ and $B^0$ are organic compounds, except gelatins and other proteins.

9. The silver halide emulsion as claimed in claim 6, wherein the said crystal defects are formed by forming at least one halogen composition gap interface during nucleation, the halogen composition gap interface making a halogen composition difference of 10 mol % or more in a $Cl^-$, $Br^-$, or $I^-$ content.

10. A silver halide color photographic light-sensitive material comprising a blue-sensitive emulsion layer, a green-sensitive emulsion layer, and a red-sensitive emulsion layer, on a support, wherein at least one of these color-sensitive emulsion layers comprises a color-sensitive layer unit that is composed of at least two light-sensitive layers each having different sensitivity; and wherein a layer having the lowest sensitivity of the color-sensitive layer unit, contains a silver halide emulsion comprising at least a dispersion medium and silver halide grains, in which 60% or more of the total projected area of the said silver halide grains is occupied by tabular grains having an epitaxial junction, which grains each have a {100} face as a main plane and an aspect ratio (diameter/thickness ratio) of from 2.0 to 100, and in which a right-angled parallelogram enclosed with {100} side faces at the main plane edges on the portion of the tabular grains, which portion does not have the epitaxial junction, or if the tabular grains have at least one corner broken off, a right-angled parallelogram formed by extending the {100} side faces at the main plane edges, has a slenderness side ratio (a ratio of the length of the long side to that of the short side) of 1 to 6, and in which the tabular grains have the epitaxial junction with a silver halide protrusion that has a higher solubility than the portion of the tabular grains, which portion does not have the epitaxial junction; and wherein a layer having the highest sensitivity of the color-sensitive layer unit, contains an emulsion comprising light-sensitive silver halide tabular grains having a {111} face as a main plane and as aspect ratio of not less than 2, and wherein the silver halide grains have an AgCl content of 0 to 50 mol %.

11. The silver halide color photographic light-sensitive material as claimed in claim 10, wherein the said tabular grains have crystal defects for anisotropic growth, and wherein a six-coordinate dopant capable of forming a shallow electron trap in the said tabular grains and/or the said silver halide protrusion, is present in a crystal lattice.

12. The silver halide color photographic light-sensitive material as claimed in claim 10, wherein the silver halide emulsion is prepared in the presence of a compound $A^0$ and/or a compound $B^0$, wherein the compound $A^0$ represents an organic compound having covalently bonded to each individual molecule thereof at least two molecules of an adsorbent that accelerates formation of a {100} face of AgBr grains, wherein the compound $B^0$ represents an organic compound, except gelatins, having at least two alcoholic groups (hydroxyl groups) per molecule, and wherein both the compounds $A^0$ and $B^0$ are organic compounds, except gelatins and other proteins.

13. The silver halide color photographic light-sensitive material as claimed in claim 11, wherein the said crystal defects are formed by addition of $Ag^+$ and halide ions with a compound $A^0$ and/or a compound $B^0$ being adsorbed on the silver halide grains, wherein the compound $A^0$ represents an organic compound having covalently bonded to each individual molecule thereof at least two molecules of an adsorbent that accelerates formation of a {100} face of AgBr grains, wherein the compound $B^0$ represents an organic compound, except gelatins, having at least two alcoholic groups (hydroxyl groups) per molecule, and wherein both the compounds $A^0$ and $B^0$ are organic compounds, except gelatins and other proteins.

14. The silver halide color photographic light-sensitive material as claimed in claim 11, wherein the said crystal defects are formed by forming at least one halogen composition gap interface during nucleation, the halogen composition gap interface making a halogen composition difference of 10 mol % or more in a $Cl^-$, $Br^-$, or $I^-$ content.

15. A silver halide color photographic light-sensitive material comprising a blue-sensitive emulsion layer, a green-sensitive emulsion layer, and a red-sensitive emulsion layer, on a support, wherein at least one of these color-sensitive emulsion layers comprises a color-sensitive layer unit that is composed of at least two light-sensitive layers each having different sensitivity; and wherein a layer having the lowest sensitivity of the color-sensitive layer unit, contains a silver halide emulsion comprising at least a dispersion medium and silver halide grains, in which 60% or more of the total projected area of the said silver halide grains is occupied by tabular grains having crystal defects for anisotropic growth, which grains each have a {100} face as a main plane and an aspect ratio (diameter/thickness ratio) of not less than 2.0, and in which a right-angled parallelogram enclosed with {100} side faces at the main plane edges of the tabular grains, or if the tabular grains have at least one corner broken off, a right-angled parallelogram formed by extending the {100} side faces at the main plane edges, has a slenderness side ratio (a ratio of the length of the long side to that of the short side) of 1 to 6, and in which a six-coordinate dopant capable of forming a shallow electron trap is present in a crystal lattice; and wherein a layer having the highest sensitivity of the color-sensitive layer unit, contains an emulsion comprising light-sensitive silver halide tabular grains having a {111} face as a main plane and an aspect ratio of not less than 2.

16. The silver halide color photographic light-sensitive material as claimed in claim 15, wherein the silver halide emulsion is prepared in the presence of a compound $A^0$ and/or a compound $B^0$, wherein the compound $A^0$ represents an organic compound having covalently bonded to each individual molecule thereof at least two molecules of an adsorbent that accelerates formation of a {100} face of AgBr grains, wherein the compound $B^0$ represents an organic compound, except gelatins, having at least two alcoholic groups (hydroxyl groups) per molecule, and wherein both the compounds $A^0$ and $B^0$ are organic compounds, except gelatins and other proteins.

17. The silver halide color photographic light-sensitive material as claimed in claim 15, wherein the said crystal defects are formed by addition of $Ag^+$ and halide ions with a compound $A^0$ and/or a compound $B^0$ being adsorbed on the silver halide grains, wherein the compound $A^0$ represents an organic compound having covalently bonded to each individual molecule thereof at least two molecules of an adsorbent that accelerates formation of a {100} face of AgBr grains, wherein the compound $B^0$ represents an organic compound, except gelatins, having at least two alcoholic groups (hydroxyl groups) per molecule, and wherein both the compounds $A^0$ and $B^0$ are organic compounds, except gelatins and other proteins.

18. The silver halide color photographic light-sensitive material as claimed in claim 15, wherein the said crystal defects are formed by forming at least one halogen composition gap interface during nucleation, the halogen composition gap interface making a halogen composition difference of 10 mol % or more in a $Cl^-$, $Br^-$, or $I^-$ content.

* * * * *